US011053036B2

(12) United States Patent
Palumbo et al.

(10) Patent No.: US 11,053,036 B2
(45) Date of Patent: Jul. 6, 2021

(54) APPARATUS AND PROCESS FOR VACUUM SKIN PACKAGING OF A PRODUCT AND A VACUUM SKIN PACKAGE

(71) Applicant: CRYOVAC, INC., Charlotte, NC (US)

(72) Inventors: Riccardo Palumbo, Arona (IT); Antonio Liperoti, Origgio (IT)

(73) Assignee: Cryovac, LLC, Charlotte, NC (US)

( * ) Notice: Subject to any disclaimer, the term of this patent is extended or adjusted under 35 U.S.C. 154(b) by 239 days.

(21) Appl. No.: 16/070,533

(22) PCT Filed: Mar. 2, 2017

(86) PCT No.: PCT/EP2017/054900
§ 371 (c)(1),
(2) Date: Jul. 17, 2018

(87) PCT Pub. No.: WO2017/149073
PCT Pub. Date: Sep. 8, 2017

(65) Prior Publication Data

US 2019/0031379 A1 Jan. 31, 2019

(30) Foreign Application Priority Data

Mar. 4, 2016 (EP) ..... 16158774

(51) Int. Cl.
*B65B 31/02* (2006.01)
*B65B 11/52* (2006.01)
(Continued)

(52) U.S. Cl.
CPC ..... *B65B 31/028* (2013.01); *B65B 11/52* (2013.01); *B65B 31/043* (2013.01); *B65B 31/06* (2013.01); *B65B 61/18* (2013.01); *B65B 41/06* (2013.01); *B65B 41/16* (2013.01); *B65B 43/52* (2013.01); *B65B 51/14* (2013.01); *B65D 75/305* (2013.01)

(58) Field of Classification Search
CPC ..... B65B 31/043; B65B 31/06; B65B 31/028; B65B 7/2885; B65B 11/52; B65B 61/18; B65B 31/021; B65B 31/04; B65D 75/305
USPC ..... 53/408, 412, 427, 433, 133.3, 509, 511, 53/557
See application file for complete search history.

(56) References Cited

U.S. PATENT DOCUMENTS 3,562,058 A * 2/1971 Boyd ..... H01L 21/3043 156/300
3,950,919 A * 4/1976 Perdue ..... B65B 11/52 53/433
(Continued)

FOREIGN PATENT DOCUMENTS

DE 102006022418 A1 * 11/2007 ..... B65B 31/06
FR 1139908 A 7/1957
(Continued)

*Primary Examiner* — Stephen F. Gerrity
*Assistant Examiner* — Joshua G Kotis
(74) *Attorney, Agent, or Firm* — Jon M. Isaacson

(57) ABSTRACT

A process and apparatus can be used to vacuum skin package a product arranged on a support comprising providing a film portion above said support with the product being arranged between the support and the film portion; air tightly fixing the film portion to the support; removing at least a portion of air from a volume underneath said film portion through said at one nozzle inserted in an interspace between the film portion and the support.

13 Claims, 20 Drawing Sheets

(51) Int. Cl.

| | |
|---|---|
| ***B65B 31/04*** | (2006.01) |
| ***B65B 31/06*** | (2006.01) |
| ***B65B 61/18*** | (2006.01) |
| ***B65B 51/14*** | (2006.01) |
| *B65B 41/16* | (2006.01) |
| *B65B 43/52* | (2006.01) |
| *B65B 41/06* | (2006.01) |
| *B65D 75/30* | (2006.01) |

(56) References Cited

U.S. PATENT DOCUMENTS 3,966,045 A * 6/1976 Perdue ..... B65B 61/18 206/443
4,009,552 A * 3/1977 Schlachter ..... B65B 31/021 53/86
4,030,388 A 6/1977 Ramsey
4,162,599 A * 7/1979 Kyle ..... B65B 31/043 53/511
4,164,109 A 8/1979 Dubois
4,870,800 A 10/1989 Kasai
4,896,479 A * 1/1990 Gannon ..... B65B 31/06 53/432
5,155,974 A * 10/1992 Garwood ..... B65B 7/168 426/129
5,481,852 A * 1/1996 Mitchell ..... B65B 31/04 426/129
6,044,622 A * 4/2000 Brady ..... B65B 25/067 426/129
6,748,726 B2 * 6/2004 Rossi ..... B29C 65/18 53/510
6,912,828 B1 * 7/2005 Yamay ..... B29C 66/8322 53/432
7,313,900 B2 * 1/2008 Granili ..... B65B 9/045 53/133.3
10,065,755 B2 9/2018 Palumbo
10,220,994 B2 * 3/2019 Palumbo ..... B65B 31/00
2001/0011445 A1 * 8/2001 Scolaro ..... B65B 31/021 53/433
2008/0104930 A1 * 5/2008 Sparakowski ..... B65B 7/164 53/432
2012/0204516 A1 8/2012 Palumbo et al.

FOREIGN PATENT DOCUMENTS

GB 696562 A 9/1953
JP 50106784 A * 8/1975 ..... B65B 31/02
JP S50106784 A 8/1975

* cited by examiner

APPARATUS AND PROCESS FOR VACUUM SKIN PACKAGING OF A PRODUCT AND A VACUUM SKIN PACKAGE

TECHNICAL FIELD

The present invention generally relates to an apparatus and to a process for vacuum skin packaging of a product.

BACKGROUND ART

Vacuum packaging is a well-known process for packaging a wide variety of products, in particular food products. Among the known vacuum packaging processes, vacuum skin packaging is employed for packaging food products such as fresh and frozen meat and fish, cheese, processed meat, ready meals and the like.

Vacuum skin packaging is basically a thermoforming process. In particular, the product is placed on a rigid or semi-rigid support (such as a tray, a bowl, a plate, or a cup). The support with the product placed thereon is put in a vacuum chamber, where a film of thermoplastic material, held above the product placed on the support, is heated and softened. The space between the support and the film is then evacuated and finally the film is released to cause the film to drape down all around the product forming a tight skin around the product and on the support.

In order to improve the removal of air from a tray during vacuum skin packaging, it is known to form a hole in the tray side wall, as disclosed in EP 0320294. Trays with pre-manufactured holes are known also from DE102006022418, U.S. Pat. No. 4,919,955, WO9714313 and US2005074531. It should however be noted that formation of holes in the tray implies a certain burden in the production chain. Moreover, the position or size of the holes or venting channels present on the tray may not be always optimized to the specific packaging machine. Additionally, the presence of holes on the tray walls causes an undesirable aesthetic perception of the overall packaging. Furthermore, in connection with the holes present on the trays disclosed in DE102006022418, U.S. Pat. No. 4,919,955 and US2005074531 valve means are provided which therefore further complicate the tray structure.

DE102006022418 also discloses an alternative where a mobile snorkel in inserted between the tray flange and the bottom surface of the closure film: in a suction position, the snorkel extends above the flange and beyond an inner border of the flange. A sealing body operative above the closure film and the flange heats the film to fix it to the tray flange substantially along the perimeter of the flange with the exception of an unsealed flange area located where the snorkel is inserted between flange and film. When the snorkel moves away from the tray flange, a further mobile heater intervenes on the portion of closure film overlapping said unsealed flange area to heat seal it to the same flange. This solution requires an additional heater which shall be properly moved and synchronized with the movement of the snorkel, causing added complexity to the apparatus. Moreover, the vacuum level that can be reached is compromised by the necessity to leave a portion of the film unsealed for at least a short time interval. WO2009141214 and WO2014060507 disclose a method for vacuum skin packaging wherein a hole is formed in the tray before removing air from the tray through said hole. This method allows to effectively obtain vacuum skin packaged products, although it requires the additional step of forming the hole in a tray wall.

It is therefore an object of the present invention to provide an apparatus and a process capable of adequately solving the problem of efficient air removal during a vacuum skin process, without impairing in term of complexity of the production cycle.

Moreover, it is an auxiliary object providing a process and an apparatus which are capable of efficiently remove air from a wide variety of trays or supports during vacuum skin packaging.

Additionally, it is an object providing a process and an apparatus which may be implemented with no need of complex changes to conventional packaging systems.

Another auxiliary object is an apparatus capable of operating in a safe manner.

A further auxiliary object is an apparatus and a process capable of achieving the goal of air removal without impairing on the aesthetics of the final packaged product.

Another object of the invention is a new package having a design allowing efficient air removal and improving the aesthetic perception of the package.

SUMMARY

At least one of the above objects is substantially reached by an apparatus and by a process according to one or more of the appended claims.

Apparatus and processes according to aspects of the invention and capable of achieving one or more of the above objects are here below described.

A 1$^{st}$ aspect concerns a—preferably vacuum skin—packaging process comprising the steps of:

- providing a support (7);
- providing a film (31; 32);
- loading the support (7) with a product (P), such that the product (P) leaves a free surface of the support (7) not contacted by the product (P);
- holding at least one film portion (33) above the product loaded support (7), with at least one nozzle (80) being positioned in an interspace (90) between an upper surface of the support (7) and a bottom surface of the film portion (33);
- heating the at least one film portion (33);
- evacuating air from below the film portion (33) by sucking gas through a suction aperture of the nozzle (80).

The free surface of the support, in the case where the support is a tray with a bottom wall, a side wall and a top flange, may include the top surface of the flange only, or the top surface of the flange and part of the inner surface of the side wall of the tray, or the top surface of the flange and part of the inner surface of the side wall of the tray.

In a 2$^{nd}$ aspect according to the first aspect the process is a vacuum skin packaging process wherein the film portion is adhered to the product exposed surface and sealed to the support leaving minimum quantity of gas inside the packaging.

In a 3$^{rd}$ aspect according to any one of the preceding aspects the process comprises the following step:

- releasing the film portion (33) and allowing the film portion (33) to contact the product (P) and heat bond to the free surface of the support (7), the heat bonding air tightly closing the product (P) between the support (7) and the film portion (33) thereby forming a vacuum skin packaged product (P).

In a 4$^{th}$ aspect according to any one of the preceding aspects the process comprises the following further step:

- removing the nozzle (80) from said interspace (90) by relatively displacing the nozzle (80) with respect to the support (7). This step takes place after heat bonding has tightly closed the product between the film portion and the support.

In a 5$^{th}$ aspect according to any one of the preceding aspects the at least one nozzle (80) is inserted between an upper surface of a peripheral border of the support (7) and a lower surface of a peripheral border of the film portion (33) such that the suction aperture of the nozzle (80) is directed towards a volume comprised between the support (7) and the film portion (33); and then air is evacuated from said volume by sucking gas through said suction aperture.

In a 6$^{th}$ aspect according to any one of the preceding aspects, the process provides that—after loading the product (P) on the support (7)—the product loaded support (7) is positioned in a packaging assembly comprising at least a lower tool (52) and an upper tool (51), wherein holding the at least one film portion (33) comprises holding by the upper tool (51) said film portion (33) in its holding position above the respective product loaded support (7) hosted in the lower tool (52).

In a 7$^{th}$ aspect according to the preceding aspect the process comprises a step of approaching to each other the upper and lower tools to bring the film portion (33) in contact with the support (7) before evacuating air from below the same film portion.

In an 8$^{th}$ aspect according to the 6$^{th}$ aspect the process comprises a step of approaching to each other the upper and lower tools to form a closed, preferably hermetically closed, packaging chamber (58) and evacuating air takes place after the upper and lower tools have formed the closed packaging chamber (58).

In a 9$^{th}$ aspect according to any one of the preceding aspects the step of evacuating air takes place also while the film portion (33) is in its holding position above the respective product loaded support (7) and continues after releasing the film portion (33) and until formation of said heat bonding which tightly closes the product (P) between the support (7) and the film portion (33).

In a 10$^{th}$ aspects according to the 8$^{th}$ and 9$^{th}$ aspects the step of evacuating air takes place also while the film portion (33) is in its holding position above and at a distance from the respective product loaded support (7).

In a 11$^{th}$ aspect according to any one of the preceding aspects, the process provides that air evacuation take place only through said at least one nozzle (80) and only when the film portion (33) has been brought into sealing contact with a peripheral border or band of the underlying support forming a sealing contact with the support (7) and with a portion of the side surface of the nozzle (80) inserted in the interspace (90). In practice, the film portion is first contacting the support (for instance the peripheral flange of the support or a peripheral band of the support) and the side surface of the nozzle (this latter being located in said interspace) to form an annular contact region which is not leaking gas surrounding the suction aperture or apertures of the nozzle(s) which thus serves as sole passage 8*s*) for suction of gas from the volume between the film portion and the support. Note that the formation of said annular contact region is facilitated by the action of the upper and lower tools which are basically sandwiching the film portion and the support with the nozzle(s) located at the respective interspace.

In a 12$^{th}$ aspect according to any one of the preceding aspects from 6$^{th}$ to 11$^{th}$:

the step of heating the film portion (33) takes place by action of a heater (54), carried by or forming the upper tool, while the film portion (33) is in its holding position above the respective product loaded support (7).

In a 13$^{th}$ aspect according to any one of the preceding aspects from 6$^{th}$ to 12$^{th}$:

the step of releasing the film portion (33) from the upper tool takes place after approaching the upper and lower tools and either bringing the film portion (33) in contact with the support (7), or forming said closed, preferably hermetically closed, packaging chamber (58), after the step of releasing—at least part of the heated film portion (33) separates and moves away from said heater (54) draping down onto the product (P).

In a 14$^{th}$ aspect according to any one of the preceding aspects from 6$^{th}$ to 13$^{th}$:

the nozzle (80) is removed, in particular completely removed, from said interspace (90) only after the heat bonding has air-tightly closed the product (P) between the support (7) and the film portion (33).

In a 15$^{th}$ aspect according to any one of the preceding aspects, the nozzle (80) is kept in said interspace (90) between the film portion (33) and the support (7) while said heat bonding step is taking place, such that at least one film flap (33*a*) is formed, which is located above said interspace (90) and which does not heat bond to the underlying support (7), thereby forming a grip element for easy opening of the skin package.

In a 16$^{th}$ aspect according to the preceding aspect the nozzle (80) is removed, in particular completely removed, from said interspace (90) after either one or both of the following occurs:

the heater (54) is separated from the film portion (33), the heater (54) surface facing the film portion (33) is brought to a temperature below the temperature causing heat bonding of the film portion (33) to the support (7).

In a 17$^{th}$ aspect according to any one of the preceding aspects, after the step of allowing the film portion (33) to contact the product (P) and heat bond to a free surface of the support (7) surrounding the product (P), the film portion (33) comprises an inner film portion (34), which is in contact with the product (P), and an outer film portion (35), entirely surrounding the perimeter of the inner film portion (33) and heat bonded to the free surface support (7) not covered by the product (P) in such a manner to form an heat bonding band also entirely surrounding the perimeter of the inner film portion (33).

In a 18$^{th}$ aspect according to any one of the preceding aspects, after the step of allowing the film portion (33) to contact the product (P) and heat bond to a free surface of the support (7) surrounding the product (P), the process comprises:

interrupting suction of gas through the nozzle (80) suction aperture, relatively displacing the nozzle (80) with respect to the support (7) to place the nozzle (80) in a rest condition at a prefixed distance from the peripheral border of the support (7).

In a 19$^{th}$ aspect according to any one of the preceding aspects, the step of removing the nozzle (80) from said interspace (90) comprises extracting the nozzle (80) from said interspace (90).

In a 20$^{th}$ aspect according to the preceding aspect, the extracting of the nozzle (80) begins before interrupting suction of gas through said nozzle (80) such that the nozzle (80) continues to suck air at least during an initial phase of its extraction from the interspace (90).

In a 21st aspect according to any one of the preceding aspects, said support (7) is a tray comprising a bottom wall (7*a*) and a side wall (7*b*) upwardly extending from said bottom wall (7*a*) and wherein said film portion (33) is heat bonded to a free surface of the side wall (7*b*) of the tray and forms the heat bonding.

In a 22nd aspect according to the preceding aspect the heat bonding is a heat bonding band extending all around the product (P) and all around the side wall (7*b*).

In a 23rd aspect according to any one of the preceding two aspects the tray comprises a top flange (7*c*) extending radially outside from the side wall (7*b*) upper portion and said interspace (90) is defined between an upper surface of the tray flange (7*c*) and a lower surface of the film portion (33), said film portion (33) being bonded to upper surface of the flange (7*c*) along the entire perimeter of the flange (7*c*) with the exception of a zone of the flange (7*c*) located at said interspace (90), to form at least one film flap (33*a*) not heat bonded to the underlying flange (7*c*).

In a 24th aspect according to the preceding aspect the at least one nozzle (80) is inserted between an upper surface of the tray flange (7*c*) and a lower surface of a peripheral border of the film portion (33) and does not extend beyond the inner border of the tray flange (7*c*).

In a 25th aspect according to any one of the preceding two aspects the film portion (33) is held in contact with the heater (54) of the upper tool (51), optionally by vacuum, also while said film portion (33) is being positioned above the product loaded tray and while the film portion (33) is being placed into contact with the flange (7*c*) of the tray.

In a 26th aspect according to any one of the preceding aspects the support (7) has a polygonal peripheral border and the nozzle (80) is positioned in an interspace (90) defined at a corner region of the support (7) peripheral border between the upper surface of the support (7) and the bottom surface of the film portion (33).

In a 27th aspect according to the preceding aspect the support (7) is a tray with a side wall (7*b*) and a radially protruding top flange (7*c*) and the peripheral border of the flange (7*c*) is polygonal and the nozzle (80) is positioned in the interspace (90) defined at a corner region of the flange (7*c*) peripheral border between the upper surface of the flange (7*c*) and the bottom surface of the film portion (33).

In a 28th aspect according to any one of the preceding aspects the film portion (33) is a discrete piece of film substantially having—when hold in its holding position above the product loaded support—a size covering substantially all the support top surface, optionally having the size capable of covering substantially all the top surface of the tray flange (7*c*).

In a 29th aspect according to any one of the preceding aspects the flange (7*c*) or the top portion of the side wall (7*b*) of the tray comprises an indent (7*d*) configured for receiving said nozzle (80), the nozzle (80) cross section presenting a profile counter-shaped to the profile of the indent (7*d*), optionally wherein the indent (7*d*) is located at a corner region of the tray.

In a 29th aspect according to any one of the preceding aspects the upper tool (51) comprises a recess configured for receiving said nozzle (80), the nozzle (80) cross section presenting a profile counter-shaped to the profile of the upper tool (51) recess.

In a 30th aspect according to any one of the preceding two aspects the nozzle (80) inserted in said interspace (90) is located either in the indent (7*d*) present in the tray or in the recess present in the upper tool (51) or in both.

A 31st aspect concerns an apparatus (1) for packaging a product (P) arranged on a support (7).

In a 32nd aspect according to the preceding aspect the apparatus is configured to implement the process according to any one of the preceding aspects.

In a 33rd aspect according to any one of the preceding two aspects the apparatus is configured for the vacuum skin packaging of a product on said support (7) which is either a flat support or which is a tray having a base wall (7*a*) and side wall (7*b*).

In a 34th aspect according to any one of the preceding aspects from the 31st to the 33rd said apparatus (1) comprises:

- a frame (1*a*);
- a transport assembly (2) arranged on the frame (1*a*) and configured for displacing one or more supports (7);
- a film supply assembly (3) configured for supplying a film;
- a packaging assembly (5) carried by said frame (la) and configured for receiving said one or more supports (7) with a product (P) arranged thereon and for holding a film portion (33) of said film above a respective of said one or more supports (7), the packaging assembly comprising:
  - a heater (54) for heating at least said film portion (33), at least one nozzle (80) provided with a suction aperture,
  - a vacuum arrangement (82) connected to the nozzle (80) and configured to cause suction of air through the nozzle (80);
- a control unit (100) connected to the packaging assembly and configured for commanding the packaging assembly to:
  - position the nozzle (80) in an interspace (90) between an upper surface of the support (7) and a bottom surface of the film portion (33),
  - cause the heater (54) to heat the at least one film portion (33) held above the support (7),
  - cause the vacuum arrangement (82) to evacuate air from below the film portion (33) by sucking gas through a suction aperture of the nozzle (80) with the nozzle (80) positioned in said interspace (90).

In a 35th aspect according to the preceding aspect the control unit is also configured for commanding the packaging assembly to:

- release the film portion (33) such that the film portion (33) contacts the product (P) and heat bonds to a free surface of the support (7) surrounding the product (P), such the heat bonding air tightly closes the product (P) between the support (7) and the film portion (33) thereby forming a vacuum skin packaged product (P), and
- then remove the nozzle (80) from said interspace (90) by causing a relative displacement of the nozzle (80) with respect to the support (7) or to the lower tool (52).

In a 36th aspect according to the preceding aspect the packaging assembly comprises:

- an upper tool (51) provided with said heater (54) and configured for holding the at least one film portion (33), and
- a lower tool (51) configured for receiving said product loaded support (7).

In a 37th aspect according to the preceding aspect the lower tool (52) and the upper tool (51) are configured to position the film portion (33) in a holding position above the respective support (7), and wherein the nozzle (80) is mounted in the packaging assembly (5) for relative movement with respect to said upper and lower tools between a working condition—where the nozzle (80) is inserted in said interspace (90)—and a rest condition—where the nozzle (80) is extracted from the interspace (90) and positioned at a prefixed distance from the peripheral border of the support (7) present in the lower tool (52).

In a 38$^{th}$ aspect according to any one of the preceding four aspects the control unit (100) is configured to command the packaging assembly (5) to:

form a closed, preferably hermetically closed, packaging chamber (58).

In a 39$^{th}$ aspect according to any one of the preceding five aspects the control unit (100) is configured to command the packaging assembly (5) to:

bring the film porting in sealing contact with the top surface of the underlying support (7) hosted in the lower tool (51) and with portion of the side surface of the nozzle.

In a 40$^{th}$ aspect according to any one of the preceding two aspects the control unit (100) is configured to command the packaging assembly (5) to:

position the nozzle (80) in said interspace (90); this phase may take place while bringing the film portion in contact with the top surface of the support or immediately thereafter.

then, after positioning of the nozzle, cause the vacuum arrangement (82) to evacuate air from below the film portion (33) by sucking gas through the suction aperture of the nozzle (80), In a 41$^{st}$ aspect according to the preceding aspect the control unit (100) is configured to command the packaging assembly (5) to—contemporaneously to or after at least an initial phase of air evacuation—release the film portion (33) such that at least a part of the film portion (33) separates from the heater (54) and contacts the product (P) while heat bonding to a free surface of the support (7) surrounding the product (P), and then remove the nozzle (80) from said interspace (90) by relatively displacing the nozzle (80) with respect to lower tool (52) and thus with respect to the support (7) present in the lower tool (52).

In a 42$^{nd}$ aspect according to any one of the preceding four aspects the control unit (100) is further configured to command the upper and lower tools to form an hermetically closed packaging chamber (58) before commanding the vacuum arrangement (82) to cause evacuation of air.

In a 43$^{rd}$ aspect according to any one of the aspects from the 34$^{th}$ to the 42$^{nd}$ the control unit (100) is configured to: command the heater (54) to heat the film portion (33) while the same film portion (33) is in its holding position above the support (7); and cause the nozzle (80) to be removed, in particular completely removed, from said interspace (90) only after the heat bonding has air-tightly closed the product (P) between the support (7) and the film portion (33).

In a 44$^{th}$ aspect according to any one of the aspects from the 34$^{th}$ to the 43$^{rd}$ the control unit (100) is configured for commanding the packaging assembly to:

maintain the nozzle (80) in said interspace (90) between the film portion (33) and the support (7) at least until after either one or both of the following occurs:

the heater (54) is separated from the film portion (33), the heater (54) surface facing the film portion (33) is brought to a temperature below the temperature causing heat bonding of the film portion (33) to the support (7), such that at least one film flap (33*a*) is formed which is located above said interspace (90) and which does not heat bond to the underlying support (7).

In a 45$^{th}$ aspect according to any one of the aspects from the 34$^{th}$ to the 44$^{th}$ the control unit (100) is configured to:

causing the vacuum arrangement (82) to interrupt suction of gas through the nozzle (80) suction aperture, relatively displacing the nozzle (80) with respect to the support (7) to place the nozzle (80) in a rest condition at a prefixed distance from the peripheral border of the support (7).

In a 46$^{th}$ aspect according to the preceding aspect the control unit (100) is configured to command said relative displacement of the nozzle (80) to begin before interrupting suction of gas through said nozzle (80) such that the nozzle (80) continues to suck air at least during an initial phase of its extraction from the interspace (90).

In a 47$^{th}$ aspect according to any one of the aspects from the 34$^{th}$ to the 46$^{th}$ the lower tool (52) is configured for receiving a support (7) in the shape of a tray comprising a bottom wall (7*a*), a side wall (7*b*) upwardly extending from said bottom wall (7*a*), and an optional top flange (7*c*) extending radially outside from the side wall (7*b*) upper portion and wherein the control unit (100) is configured to command the packaging assembly to position the nozzle (80) in the working condition in the interspace (90) defined between a lower surface of the film portion (33) hold by the upper tool (51) and the flange (7*c*) upper surface or the upper portion of the side wall (7*b*) of a tray positioned in the lower tool (52).

In a 48$^{th}$ aspect according to the preceding aspect the control unit (100) is configured to command the packaging assembly (5) to position the nozzle (80) in the working condition to radially extend beyond an outer border of the tray flange (7*c*) but not to radially extend beyond an inner border of the same tray flange (7*c*) of a tray positioned in said lower tool (52).

In a 49$^{th}$ aspect according to any one of the aspects from the 34$^{th}$ to the 48$^{th}$ the control unit (100) is configured to command holding means (59) associated to the upper tool (51) to hold the film portion (33) in contact with a heating surface of a heater (54) carried by the upper tool (51) while said film portion (33) is being positioned above the support (7) hosted in the lower tool (52).

In a 50$^{th}$ aspect according to the preceding aspect the holding means (59) comprises a plurality of suction apertures leading to the active surface of the heater (54) and at least one vacuum source (59*b*) controlled by the control unit (100) and connected to the suction apertures, the control unit (100) being configured for commanding the vacuum source (59*b*) to keep the film portion (33) in contact with said suction apertures until the film portion peripheral border has contacted the flange (7*c*) of the tray.

In a 51$^{st}$ aspect according to any one of the aspects from the 34$^{th}$ to the 50$^{th}$ the lower tool (52) is configured to receive a support (7) having a polygonal peripheral border and wherein the control unit (100) is configured to command the packaging assembly (5) to position the nozzle (80) in the working condition in an interspace (90) defined at a corner region of the peripheral border of the tray (7) positioned in the lower tool (52).

In a 52$^{nd}$ aspect according to any one of the aspects from the 34$^{th}$ to the 51$^{st}$ the film supply assembly (3) is configured for supplying a continuous film (31); and the apparatus further comprises a cutting unit (4) configured to form the film portion (33) as a discrete piece of film cut from the continuous film and substantially having the radial size of the support (7), optionally having the radial size of the tray flange (7*c*); said cutting unit being operative outside the packaging assembly at a cutting station located between the film supply assembly and the packaging assembly or said cutting unit being part of the packaging assembly and being carried by the upper and/or lower tool (51, 52).

In a 53$^{rd}$ aspect according to any one of the aspects from the 34$^{th}$ to the 52$^{nd}$ the lower tool (52) is configured for receiving a support (7) in the shape of a tray comprising a bottom wall (7*a*), a side wall (7*b*) upwardly extending from said bottom wall (7*a*) and an optional top flange (7*c*) extending radially outside from the side wall (7*b*) upper portion of the flange (7*c*), with said flange (7*c*) or the top portion of the side wall (7*b*) of the tray comprising an indent (7*d*) configured for receiving said nozzle (80), the nozzle (80) cross section presenting a profile counter-shaped to the profile of the indent (7*d*), optionally wherein the indent (7*d*) is located at a corner region of the tray.

In a 54$^{th}$ aspect according to any one of the aspects from the 34$^{th}$ to the 53$^{rd}$ the upper tool (51) comprises a recess configured for receiving said nozzle (80), the nozzle (80) cross section presenting a profile counter-shaped to the profile of the upper tool (51) recess.

In a 55$^{th}$ aspect according to any one of the preceding two aspects the control unit (100) is configured to command the packaging assembly to position the nozzle (80) in said interspace (90) either in correspondence of the indent (7*d*) present in the tray or in correspondence of the recess present in the upper tool (51).

In a 56$^{th}$ aspect according to any one of the preceding aspects the nozzle (80) or at least an external coating applied to the nozzle (80) is made in non-stick material. The non-stick material is in particular selected not to stick to heated plastic films of the type disclosed in the detailed description when heated to bond to the support.

In a 57$^{th}$ aspect according to any one of the preceding aspects the nozzle (80) cross section presents elongated conformation and is preferably polygonal, for example rectangular, further wherein the nozzle (80) suction aperture optionally comprises a plurality of suction orifices regularly distributed at the distal end of the nozzle (80).

A 58$^{th}$ aspect concerns a vacuum skin package, for instance of the type obtainable with the process of any one of the preceding aspects comprising:

- a tray (7) presenting a bottom wall (7*a*) and a side wall (7*b*) upwardly extending from said bottom wall (7*a*); and an optional flange (7*c*) extending outwardly from an upper portion of the side wall of the tray;
- a product (P) loaded on the tray (7);
- a film portion (33) draped over the product and welded, in particular heat bonded, to an inner surface of the tray not occupied by the product (P);

wherein the flange or the top portion of the side wall of the tray comprises an indent (7*d*).

In a 59$^{th}$ aspect according to the preceding aspect the indent (7*d*) is located at a corner region of the flange or of the sidewall.

In a 60$^{th}$ aspect according to any one of the preceding two aspects the tray (7) comprises the top flange (7*a*) extending radially outside from the side wall upper portion and provided with said indent (7*d*).

In a 61$^{st}$ aspect according to any one of the preceding three aspects said film portion (33) is bonded to upper surface of the flange (7*c*) along the entire perimeter of the flange with the exception of a zone of the flange where the indent (7*d*) is formed to define at least one film flap (33*a*) not heat bonded to the underlying flange (7*c*).

In a 62$^{nd}$ aspect according to any one of the preceding four aspects the indent (7*d*) in the flange and the film flap (33*a*) are located at said flange corner region.

In a 63$^{rd}$ aspect according to any one of the preceding five aspects the indent (7*d*) is formed by a reduction in the height of the side wall (7*c*), has a constant depth and an extension along the perimeter of the flange or of the side wall which is at least twice the depth of the indent.

In a 64$^{th}$ aspect according to any one of the preceding six aspects the film portion (33) comprises an inner film portion (34), which is in contact with the product (P), and an outer film portion (35), entirely surrounding the perimeter of the inner film portion and heat bonded to the free surface of the support not covered by the product in such a manner to define an annular heat bonding band (91) also entirely surrounding the perimeter of the inner film portion and encircling the area or areas of contact of the product with the support.

In a 65$^{th}$ aspect according to the preceding aspect the annular heat bonding band (91) extends up to the top border of the side wall, and optionally covers the flange (7*c*) with the exclusion of the zone of said indent (7*d*).

In a 66$^{th}$ aspect according to any one of the preceding eight aspects the indent (7*d*) and/or the flap (33*a*) are delimited on both sides by a distinct sealing line connecting the film to the flange and extending transverse to the external peripheral border of the flange.

In a 67$^{th}$ aspect according to any one of the preceding aspects from the 58$^{th}$ to the 65$^{th}$ the indent (7*d*) and/or the flap (33*a*) are delimited between the external border of the corner region of the flange and a single sealing line crossing the corner region of the flange tangentially with respect to the side wall of the tray.

BRIEF DESCRIPTION OF THE DRAWINGS

Aspects of the present invention are disclosed in the following detailed description, which is provided by way of example and should not be read in a limitative manner.

The description makes reference to the accompanying drawings, wherein:

FIG. 9, the solution shown in FIG. 9B has the heater is in a single body;

THE TRAYS OR SUPPORTS

Figure 1:
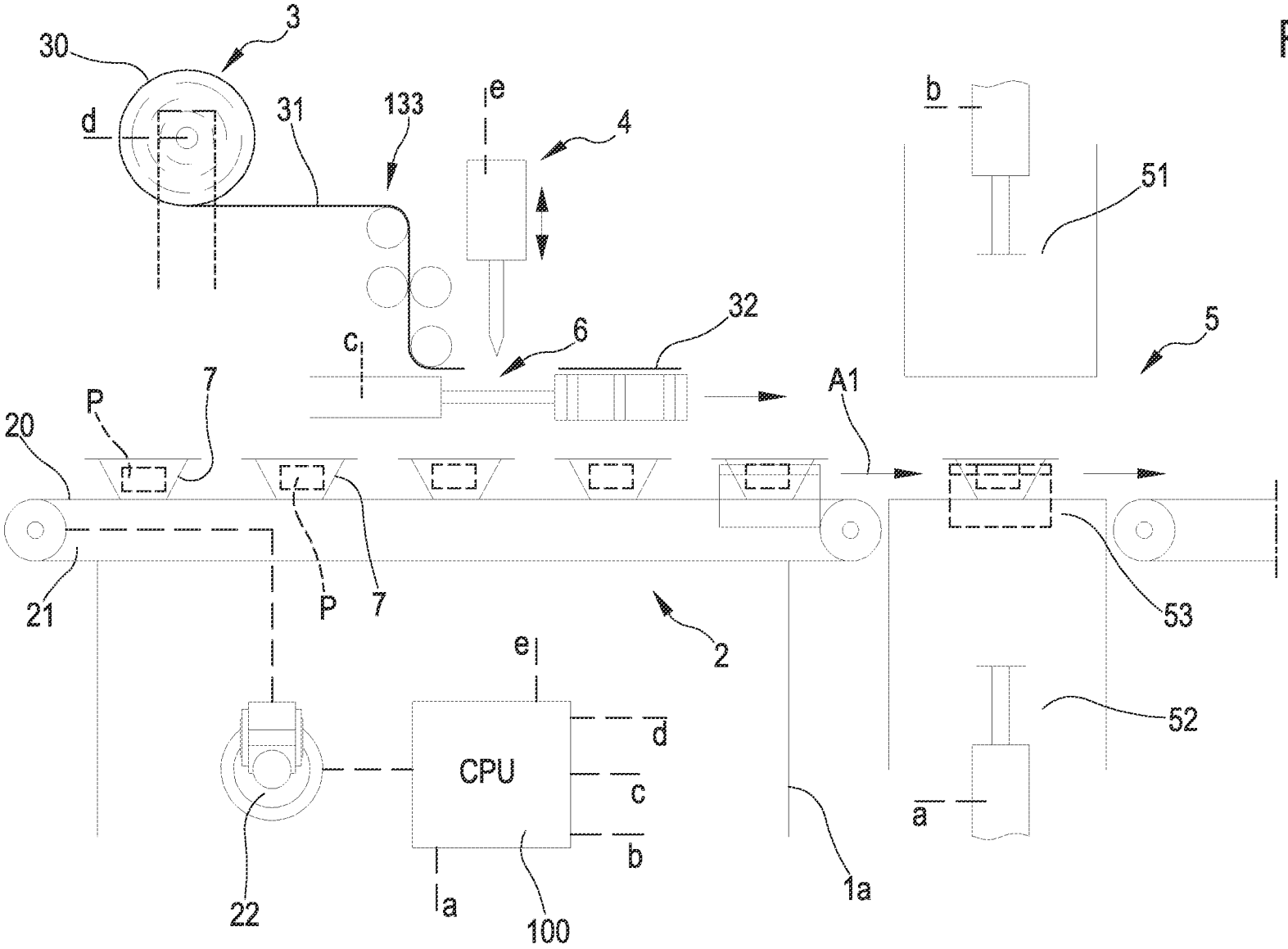
FIG. 1 shows a layout of a first embodiment of a packaging apparatus according to certain aspects of the invention.

As used herein support means a flat or substantially flat support or a container of the type having a base wall, a side wall and optionally a top flange radially emerging from the side wall; the support or tray may be made either in plastic material or in cardboard or in one or more cardboard layers combined with one or more plastic layers.

The tray or supports may have a polygonal, e.g., rectangular, shape (when seen from above) or any other suitable shape, such as round, square, elliptical and other.

Trays or supports with a side wall may for example be manufactured by thermoforming or injection molding. Tray or supports of flat conformation may be extruded, co-extruded, laminated and then the cut to size.

The trays or supports described and claimed herein are preferably, although not limited to, made of a single layer or of a multi-layer polymeric material.

In case of a single layer material suitable polymers are for instance polystyrene, polypropylene, polyesters, high density polyethylene, poly(lactic acid), PVC and the like, either formed or solid.

Preferably the tray or support is provided with gas barrier properties. As used herein such term refers to a film or sheet of material which has an oxygen transmission rate of less than 200 cm3/m2-day-bar, less than 150 cm3/m2-day-bar, less than 100 cm3/m2-day-bar as measured according to ASTM D-3985 at 23° C. and 0% relative humidity. Suitable materials for gas barrier monolayer thermoplastic trays 4 are for instance polyesters, polyamides and the like.

If the tray or support is made of a multi-layer polymeric material, suitable polymers are for instance ethylene homo- and co-polymers, propylene homo- and co-polymers, polyamides, polystyrene, polyesters, poly(lactic acid), PVC and the like. Part of the multi-layer material can be solid and part can be foamed.

For example, the tray or support may comprises at least one layer of a foamed polymeric material chosen from the group consisting of polystyrene, polypropylene, polyesters and the like.

The multi-layer material may be produced either by co-extrusion of all the layers using co-extrusion techniques or by glue- or heat-lamination of, for instance, a rigid foamed or solid substrate with a thin film, usually called "liner". The thin film may be laminated either on the side of the tray or support 4 in contact with the product P or on the side facing away from the product P or on both sides. In the latter case the films laminated on the two sides of the tray or support may be the same or different. A layer of an oxygen barrier material, for instance (ethylene-co-vinyl alcohol) copolymer, is optionally present to increase the shelf-life of the packaged product P.

Gas barrier polymers that may be employed for the gas barrier layer are PVDC, EVOH, polyamides, polyesters and blends thereof. The thickness of the gas barrier layer will be set in order to provide the tray with an oxygen transmission rate suitable for the specific packaged product.

The tray or support may also comprise a heat sealable layer. Generally, the heat-sealable layer will be selected among the polyolefins, such as ethylene homo- or co-polymers, propylene homo- or co-polymers, ethylene/vinyl acetate copolymers, ionomers, and the homo- and co-polyesters, e.g. PETG, a glycol-modified polyethylene terephthalate.

Additional layers, such as adhesive layers, to better adhere the gas-barrier layer to the adjacent layers, may be present in the gas barrier material for the tray and are preferably present depending in particular on the specific resins used for the gas barrier layer.

In case of a multilayer material used to form the tray or support, part of this structure may be foamed and part may be un-foamed. For instance, the tray or support may comprise (from the outermost layer to the innermost food-contact layer) one or more structural layers, typically of a material such as foam polystyrene, foam polyester or foam polypropylene, or a cast sheet of e.g. polypropylene, polystyrene, poly(vinyl chloride), polyester or cardboard; a gas barrier layer and a heat-sealable layer.

The tray or support may be obtained from a sheet of foamed polymeric material having a film comprising at least one oxygen barrier layer and at least one surface sealing layer laminated onto the side facing the packaged product, so that the surface sealing layer of the film is the food contact layer the tray. A second film, either barrier or non-barrier, may be laminated on the outer surface of the tray.

Specific tray or support formulations are used for food products which require heating in conventional or microwave oven before consumption. The surface of the container in contact with the product, i.e. the surface involved in the formation of the seal with the lidding film, comprises a polyester resin. For instance the container can be made of a cardboard coated with a polyester or it can be integrally made of a polyester resin. Examples of suitable containers for the package of the invention are CPET, APET or APET/CPET containers. Such container can be either foamed or not-foamed.

Trays or supports containing foamed parts, have a total thickness lower than 8 mm, and for instance may be comprised between 0.5 mm and 7.0 mm and more frequently between 1.0 mm and 6.0 mm.

In case of rigid tray not containing foamed parts, the total thickness of the single-layer or multi-layer thermoplastic material is preferably lower than 2 mm, and for instance may be comprised between 0.1 mm and 1.2 mm and more frequently between 0.2 mm and 1.0 mm.

The Film or Film Material

The film or film material described and claimed herein may be applied to the tray or support 4 to form a skin associated to the tray and matching the contour of the product.

The film for skin applications may be made of a flexible multi-layer material comprising at least a first outer heat-sealable layer, an optional gas barrier layer and a second outer heat-resistant layer. The outer heat-sealable layer may comprise a polymer capable of welding to the inner surface of the supports carrying the products to be packaged, such as for instance ethylene homo- or co-polymers, like LDPE, ethylene/alpha-olefin copolymers, ethylene/acrylic acid copolymers, ethylene/methacrylic acid copolymers, and ethylene/vinyl acetate copolymers, ionomers, co-polyesters, e.g. PETG. The optional gas barrier layer preferably comprises oxygen impermeable resins like PVDC, EVOH, polyamides and blends of EVOH and polyamides. The outer heat-resistant layer may be made of ethylene homo- or copolymers, ethylene/cyclic-olefin copolymers, such as ethylene/norbornene copolymers, propylene homo- or co-polymers, ionomers, (co)polyesters, (co)polyamides. The film may also comprise other layers such as adhesive layers or bulk layers to increase thickness of the film and improve its abuse and deep drawn properties. Particularly used bulk layers are ionomers, ethylene/vinyl acetate copolymers, polyamides and polyesters. In all the film layers, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents and the like additives known to those skilled in the art of packaging films.

One or more layers of the film can be cross-linked to improve the strength of the film and/or its heat resistance. Cross-linking may be achieved by using chemical additives or by subjecting the film layers to an energetic radiation treatment. The films for skin packaging are typically manufactured in order to show low shrink when heated during the packaging cycle. Those films usually shrink less than 15% at 160° C., more frequently lower than 10%, even more frequently lower than 8% in both the longitudinal and transversal direction (ASTM D2732). The films usually have a thickness comprised between 20 microns and 200 microns, more frequently between 40 and 180 microns and even more frequently between 50 microns and 150 microns.

In all the film layers herein described, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents, anti-fog agents or compositions, and the like additives known to those skilled in the art of packaging films.

Definitions and Conventions Concerning Materials

PVDC is any vinylidene chloride copolymers wherein a major amount of the copolymer comprises vinylidene chloride and a minor amount of the copolymer comprises one or more unsaturated monomers copolymerisable therewith, typically vinyl chloride, and alkyl acrylates or methacrylates (e.g. methyl acrylate or methacrylate) and the blends thereof in different proportions. Generally a PVDC barrier layer will contain plasticisers and/or stabilizers as known in the art.

As used herein, the term EVOH includes saponified or hydrolyzed ethylene-vinyl acetate copolymers, and refers to ethylene/vinyl alcohol copolymers having an ethylene comonomer content preferably comprised from about 28 to about 48 mole %, more preferably, from about 32 to about 44 mole % ethylene, and even more preferably, and a saponification degree of at least 85%, preferably at least 90%.

The term "polyamides" as used herein is intended to refer to both homo- and co- or ter-polyamides. This term specifically includes aliphatic polyamides or co-polyamides, e.g., polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partially aromatic polyamides or co-polyamides, such as polyamide 6I, polyamide 6I/6T, polyamide MXD6, polyamide MXD6/MXDI, and blends thereof.

As used herein, the term "copolymer" refers to a polymer derived from two or more types of monomers, and includes terpolymers. Ethylene homopolymers include high density polyethylene (HDPE) and low density polyethylene (LDPE). Ethylene copolymers include ethylene/alpha-olefin copolymers and ethylene/unsaturated ester copolymers. Ethylene/alpha-olefin copolymers generally include copolymers of ethylene and one or more comonomers selected from alpha-olefins having from 3 to 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 g/cm3. The term linear low density polyethylene (LLDPE) is generally understood to include that group of ethylene/alpha-olefin copolymers which fall into the density range of about 0.915 to about 0.94 g/cm3 and particularly about 0.915 to about 0.925 g/cm3. Sometimes linear polyethylene in the density range from about 0.926 to about 0.94 g/cm3 is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers may be obtained by either heterogeneous or homogeneous polymerization processes.

Another useful ethylene copolymer is an ethylene/unsaturated ester copolymer, which is the copolymer of ethylene and one or more unsaturated ester monomers. Useful unsaturated esters include vinyl esters of aliphatic carboxylic acids, where the esters have from 4 to 12 carbon atoms, such as vinyl acetate, and alkyl esters of acrylic or methacrylic acid, where the esters have from 4 to 12 carbon atoms.

Ionomers are copolymers of an ethylene and an unsaturated monocarboxylic acid having the carboxylic acid neutralized by a metal ion, such as zinc or, preferably, sodium.

Useful propylene copolymers include propylene/ethylene copolymers, which are copolymers of propylene and ethylene having a majority weight percent content of propylene, and propylene/ethylene/butene terpolymers, which are copolymers of propylene, ethylene and 1-butene.

As used herein, the term "polyolefin" refers to any polymerized olefin, which can be linear, branched, cyclic, aliphatic, aromatic, substituted, or unsubstituted. More specifically, included in the term polyolefin are homopolymers of olefin, co-polymers of olefin, co-polymers of an olefin and a non-olefinic co-monomer co-polymerizable with the olefin, such as vinyl monomers, modified polymers thereof, and the like. Specific examples include polyethylene homo-polymer, polypropylene homo-polymer, polybutene homo-polymer, ethylene-alpha-olefin co-polymer, propylene-alpha-olefin co-polymer, butene-alpha-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, polymethylpentene, etc.

The term "polyester" is used herein to refer to both homo- and co-polyesters, wherein homo-polyesters are defined as polymers obtained from the condensation of one dicarboxylic acid with one diol and co-polyesters are defined as polymers obtained from the condensation of one or more dicarboxylic acids with one or more diols. Suitable polyester resins are, for instance, polyesters of ethylene glycol and terephthalic acid, i.e. poly(ethylene terephthalate) (PET). Preference is given to polyesters which contain ethylene units and include, based on the dicarboxylate units, at least 90 mol %, more preferably at least 95 mol %, of terephthalate units. The remaining monomer units are selected from other dicarboxylic acids or diols. Suitable other aromatic dicarboxylic acids are preferably isophthalic acid, phthalic acid, 2,5-, 2,6- or 2,7-naphthalenedicarboxylic acid. Of the cycloaliphatic dicarboxylic acids, mention should be made of cyclohexanedicarboxylic acids (in particular cyclohexane-1,4-dicarboxylic acid). Of the aliphatic dicarboxylic acids, the (C3-Ci9)alkanedioic acids are particularly suitable, in particular succinic acid, sebacic acid, adipic acid, azelaic acid, suberic acid or pimelic acid. Suitable diols are, for example aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol, optionally heteroatom-containing diols having one or more rings.

Co-polyester resins derived from one or more dicarboxylic acid(s) or their lower alkyl (up to 14 carbon atoms) diesters with one or more glycol(s), particularly an aliphatic or cycloaliphatic glycol may also be used as the polyester resins for the base film. Suitable dicarboxylic acids include aromatic dicarboxylic acids such as terephthalic acid, isophthalic acid, phthalic acid, or 2,5-, 2,6- or 2,7-naphthalenedicarboxylic acid, and aliphatic dicarboxylic acids such as succinic acid, sebacic acid, adipic acid, azelaic acid, suberic acid or pimelic acid. Suitable glycol(s) include aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol. Examples of such copolyesters are (i) copolyesters of azelaic acid and terephthalic acid with an aliphatic glycol, preferably ethylene glycol; (ii) copolyesters of adipic acid and terephthalic acid with an aliphatic glycol, preferably ethylene glycol; and (iii) copolyesters of sebacic acid and terephthalic acid with an aliphatic glycol, preferably butylene glycol; (iv) co-polyesters of ethylene glycol, terephthalic acid and isophthalic acid. Suitable amorphous co-polyesters are those derived from an aliphatic diol and a cycloaliphatic diol with one or more, dicarboxylic acid(s), preferably an aromatic dicarboxylic acid. Typical amorphous copolyesters include co-polyesters of terephthalic acid with an aliphatic diol and a cycloaliphatic diol, especially ethylene glycol and 1,4-cyclohexanedimethanol.

DETAILED DESCRIPTION

It should be noted that in the present detailed description corresponding parts shown in the various Figures are indicated with the same reference numeral through the Figures. Note that the Figures are not in scale.

Figure 13:
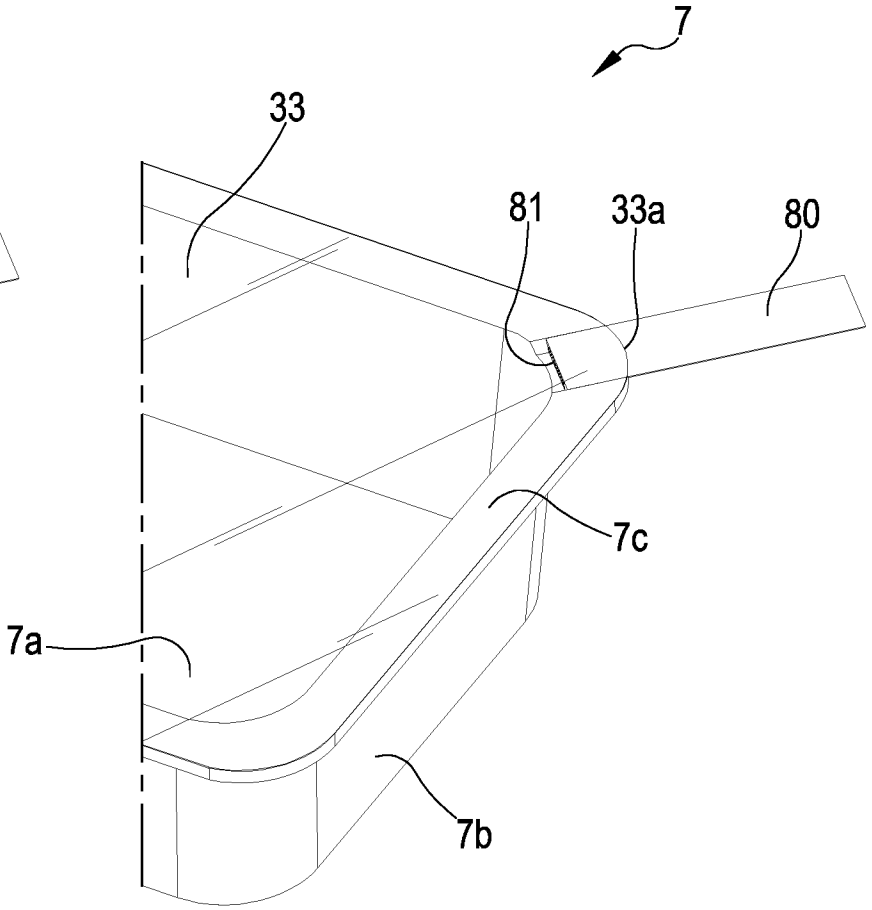
FIG. 13 is an interrupted perspective view of the tray of FIG. 12 with a film sheet applied to the tray top flange and the nozzle inserted in the interspace between the film sheet and the tray flange at the corner recess; the figure shows a situation before application of vacuum (for sake of clarity the product P is not represented)
Figure 12:
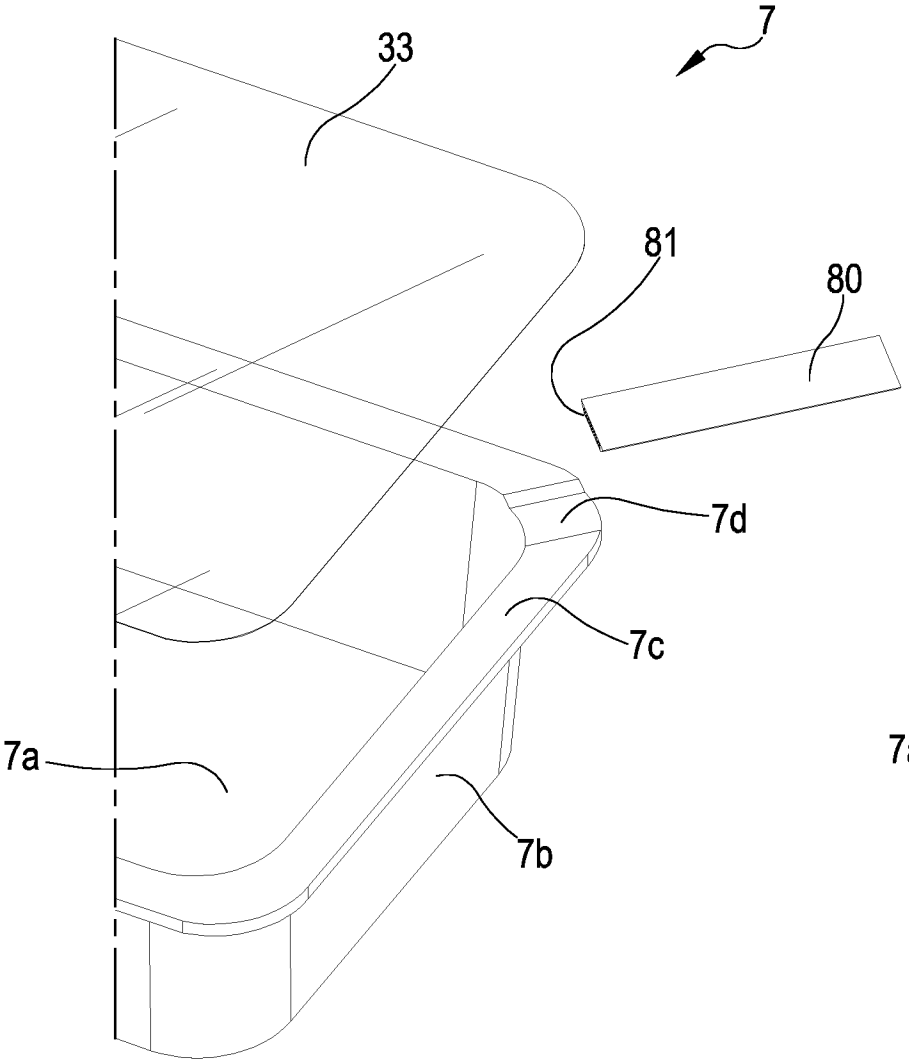
FIG. 12 is an interrupted perspective view of an example of a support usable for the packaging process of the invention, wherein the support is the form of a tray provided with a flange with a contoured corner recess designed to receive an air suction nozzle.

FIG. 1 discloses an apparatus 1 for packaging of a product P arranged on a support 7 which can be a flat support or a tray (see particularly FIGS. 12-14) having a base wall 7*a*, a side wall 7*b* and optionally a top flange 7*c* emerging from the side wall. The apparatus 1 is for instance configured for vacuum skin packaging of the product where a thin film of plastic material is draped down on the product P and intimately adheres to the inner surface of the tray or to the upper surface of the flat support not covered by the product, to the top flange if present, as well as to the product surface thus leaving a minimum, if any, amount of air within the packaging.

The apparatus 1 comprises a frame 1*a*, a transport assembly 2 configured for displacing the support or tray 7, a film supply assembly 3, an optional film cutting assembly 4, and a packaging assembly 5.

The frame 1*a* defines the fixed structure supporting the various parts of the apparatus and may include one single fixed structure of a plurality of fixed structures.

The transport assembly 2 is carried by the frame 1*a* and serves to displace the support or trays 7 along a predefined path. The design of the transport assembly 2 is not particularly relevant to the present invention and any know solution may thus be used. For instance, the transport assembly 2 may comprise a displacement plane 20 (which may be a physical plane where the trays or supports are lying and slide or an ideal plane along which the trays or supports are guided e.g. by means of railways or guides). The plane 20 is defined on a top area of the frame and a conveyor 21 is arranged in correspondence of the plane 20. In the example shown, the transport assembly 2 is carried by, e.g. fixed to, the frame 1*a* so that the plane 20 is substantially horizontal and the conveyor 21 moves the trays or supports according to the horizontal direction indicated by the arrow A1. The transport assembly 2 is configured for displacing the support or tray along a predefined path from a loading station (not shown), where supports or trays which may already be filled with the respective product(s) P are positioned, to the packaging assembly 5 where a film is tightly fixed to each support or tray, as it will be explained here below in detail. The conveyor 21 displaces the trays or supports, e.g. a prefixed number of trays per time, inside the packaging assembly 5 in proper position for receiving the cut film sheets or in any case a portion of the film. For instance, a control unit 100 (operation of which will be further described herein after) may control the conveyor 21 to displace a prefixed number of trays or supports per time from a region outside the packaging assembly to a region inside the packaging assembly where the tray or supports are in vertical alignment to the film sheets or film portions to which the tray or support need to be sealed. The conveyor 21 may for instance include a first transfer tool (such as a belt), configured for bringing the trays or supports in close proximity to the packaging assembly 5, and a second transfer tool (not shown), adapted to pick one or more of said trays or supports and bring them into the packaging assembly 5. The second transfer tool may for instance include arms acting on the sides of the trays or supports such as to pick the supports from the first transfer tool, bring them into the packaging assembly and then return to the first transfer tool to pick a new set of trays or supports. Alternatively, the conveyor 21 may include pushers (e.g. in the form of bars extending transverse to said direction A1) acting on the trays or supports and pushing them inside the packaging assembly. The pushers may be moved by chains or belts and may be moved into the packaging assembly to properly position a number of trays or supports, and then be retracted from the packaging assembly, once the trays or supports have reached their proper position inside this latter. According to a further alternative, the conveyor 21 may include housings (e.g. in the form of plates or bodies provided with cavities for receiving a number of trays or supports) which are moved along said direction A1 and which are moving inside the packaging assembly together with the supports or trays: according to this last alternative the housings are properly shaped in order to be hosted inside the packaging assembly during the application of the film sheet or film portion to the tray or support. The transport assembly 2 further comprises a motor 22, e.g. a stepping motor unit, for operating the conveyor 21, for example with step-by-step movement. Although several alternatives have been described for conveying the supports or trays into the packaging assembly, any other convenient means adapted to position the supports or trays in the packaging assembly may be used as the specific structure and design of the transport assembly 2 is not relevant to the claimed invention. Note that the products may be positioned on the support or tray 7 either upstream the loading station or in any location between the loading station and the packaging assembly 5. In a further alternative, which is not shown in the drawings, the tray or supports may be online formed: in other words, instead of having a tray loading station, a further film material may be supplied from a further film supply station and fed to a thermoforming tool positioned on the frame 1*a* and configured for forming the supports or trays. Thermoforming tools are known in the art and are therefore not further described.

The film supply assembly 3 is configured for supplying the film which will then be sealed to the support or trays 7. For instance, the film supply assembly 3 may comprise a film roll 30 which supplies a continuous film 31. The film supplying assembly 3 may further comprise an arm or other structure fixed to the frame 1*a* and suitable for rotatably supporting the roll 30. Further, the film supplying assembly 3 may comprise film punching devices (not show as per se known) configured essentially to provide the correct profile to the film edges. The punching devices may also help to keep an unrolled portion of film pulled from the film roll aligned according to a prefixed direction. The film supplying assembly 3 may also comprises pinch rollers and/or other means 133 for pulling the film from the roll 10 and properly position it at the cutting assembly 4 (for instance said means may comprise pincers acting on the side of the film and/or pincers acting on the front edge of the film and configured to pull the film). The film rolled on the film roll may be made and have the structure disclosed in the above section dedicated to the film, depending upon the specific need.

Figure 2:
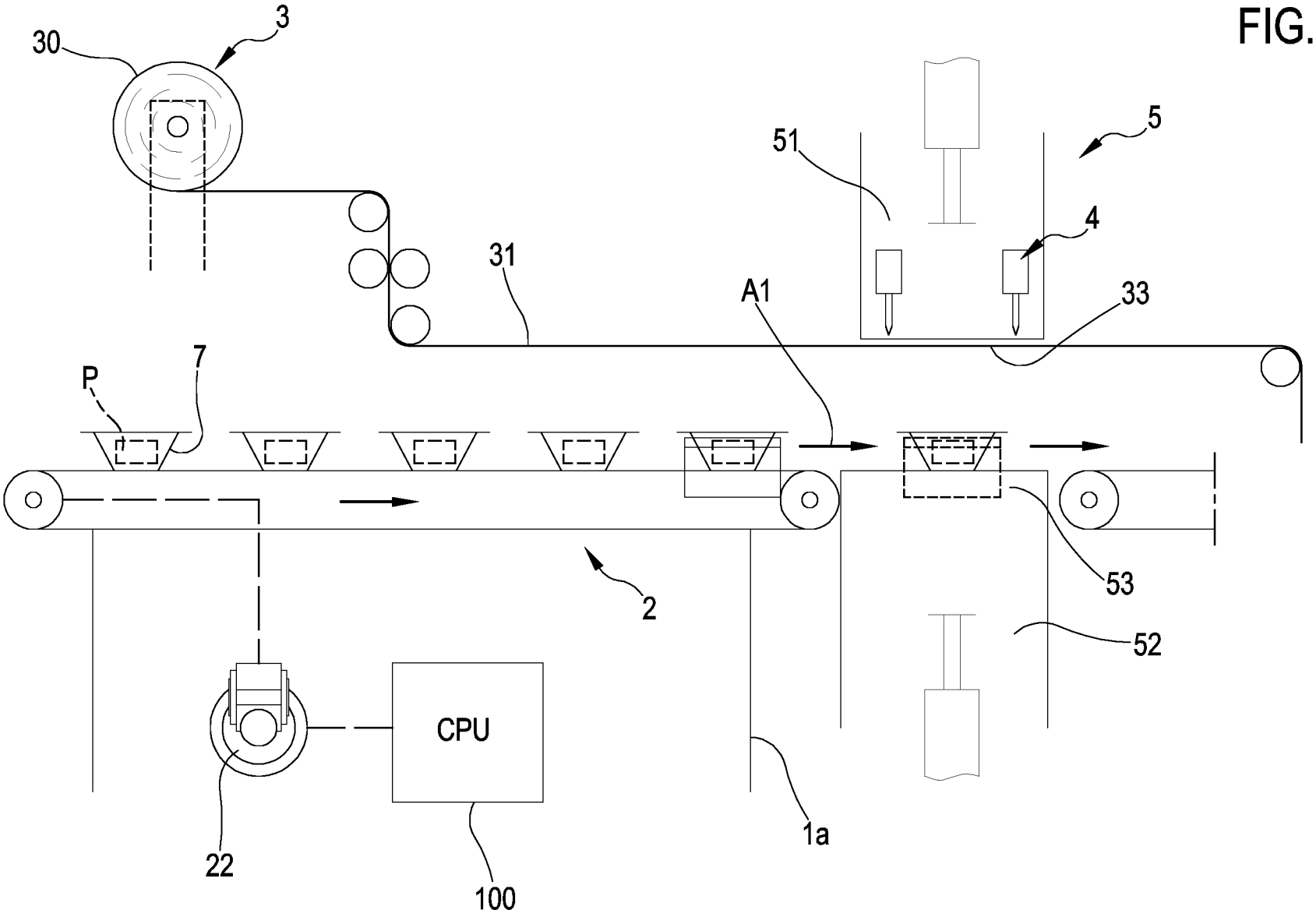
FIG. 2 shows a layout of a second embodiment of a packaging apparatus according to certain aspects of the invention.
Figure 3:
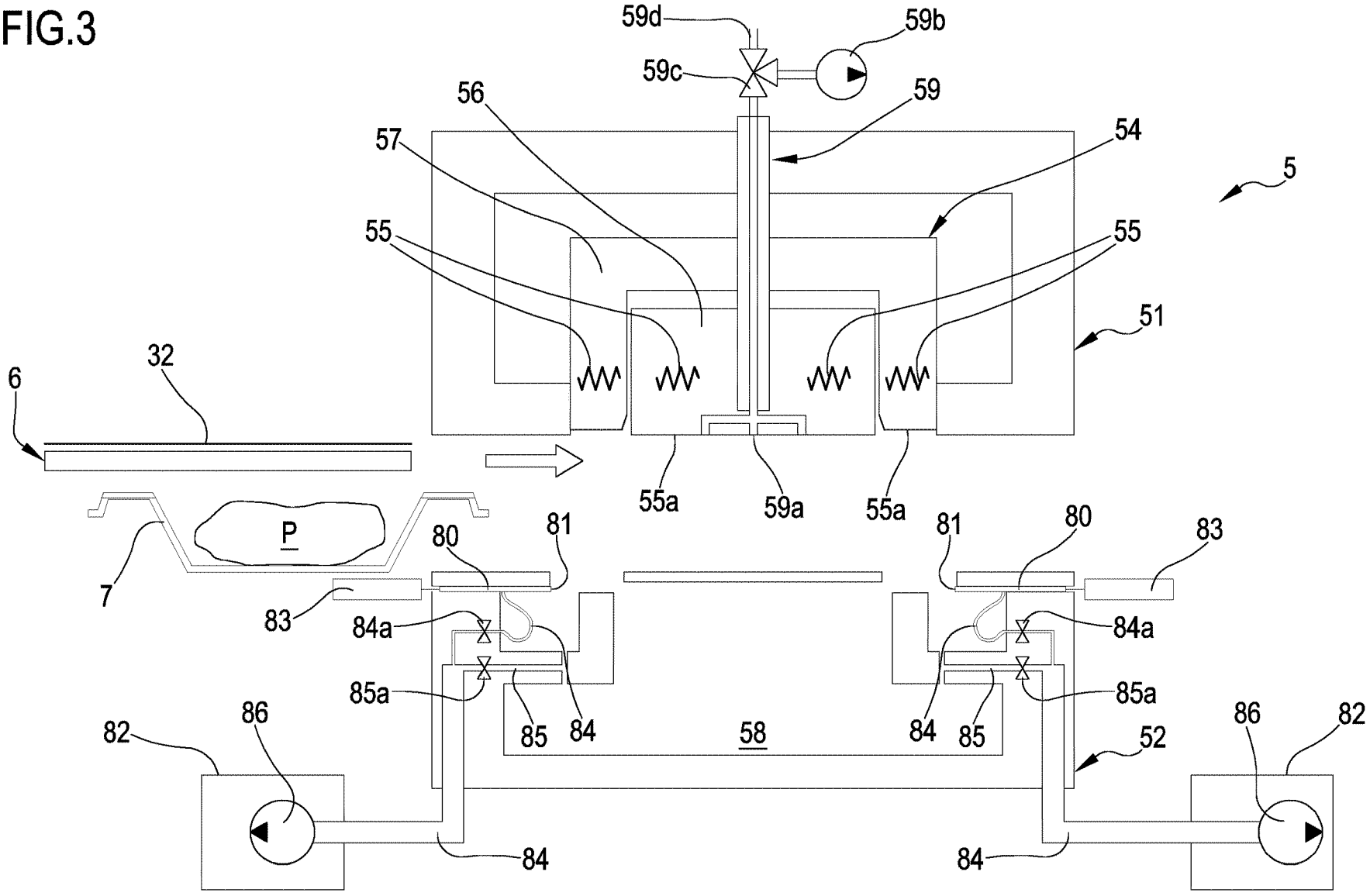
FIGS. 3 to 8, 9, 10 and 11 show a possible structure of the packaging assembly of the apparatus of FIG. 1 during various phases of a packaging process; according to the solution shown in this figures the packaging assembly is capable of forming an hermetic chamber housing the film portion positioned above the product loaded tray to be sealed.
Figure 4:
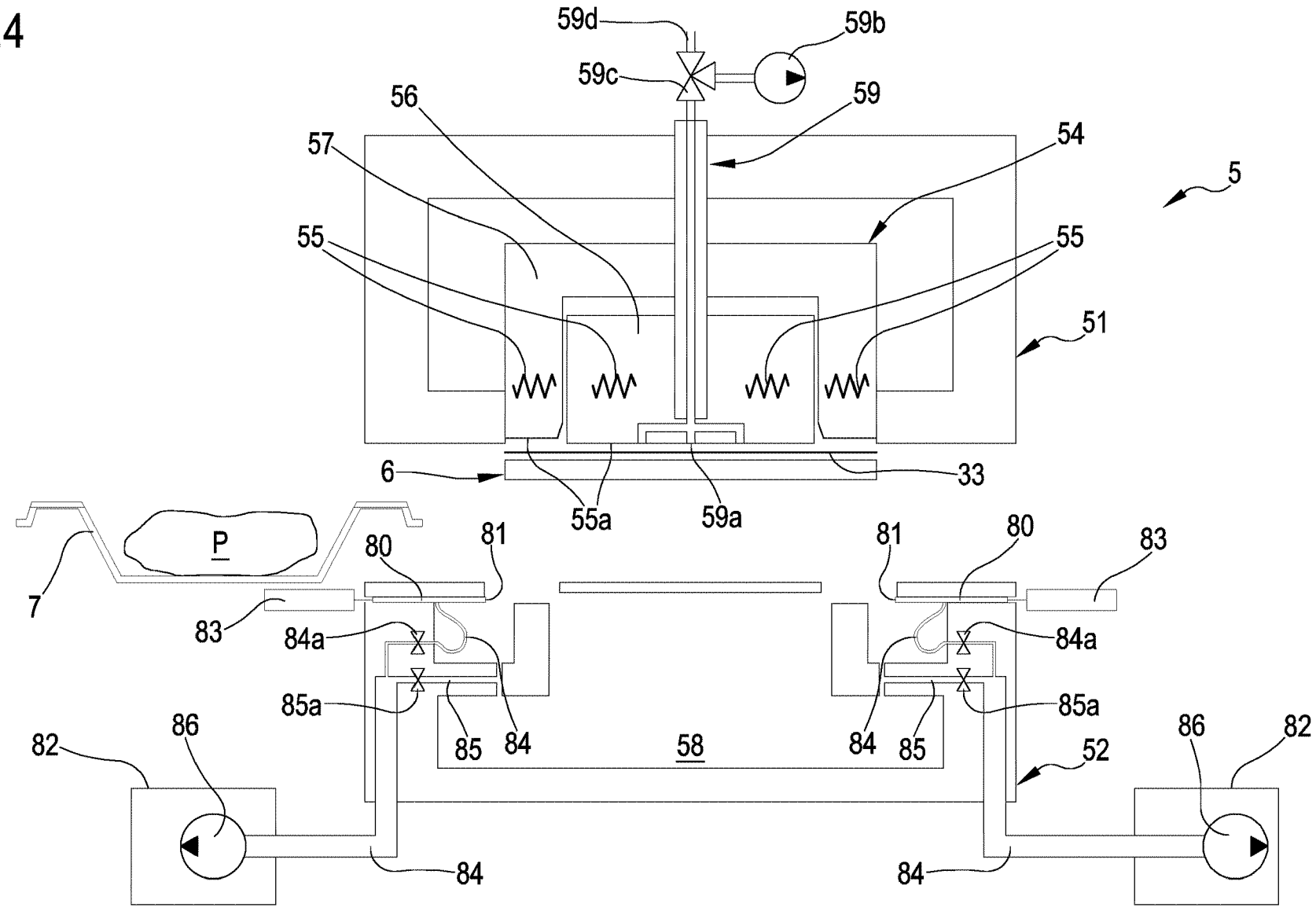
Figure 5:
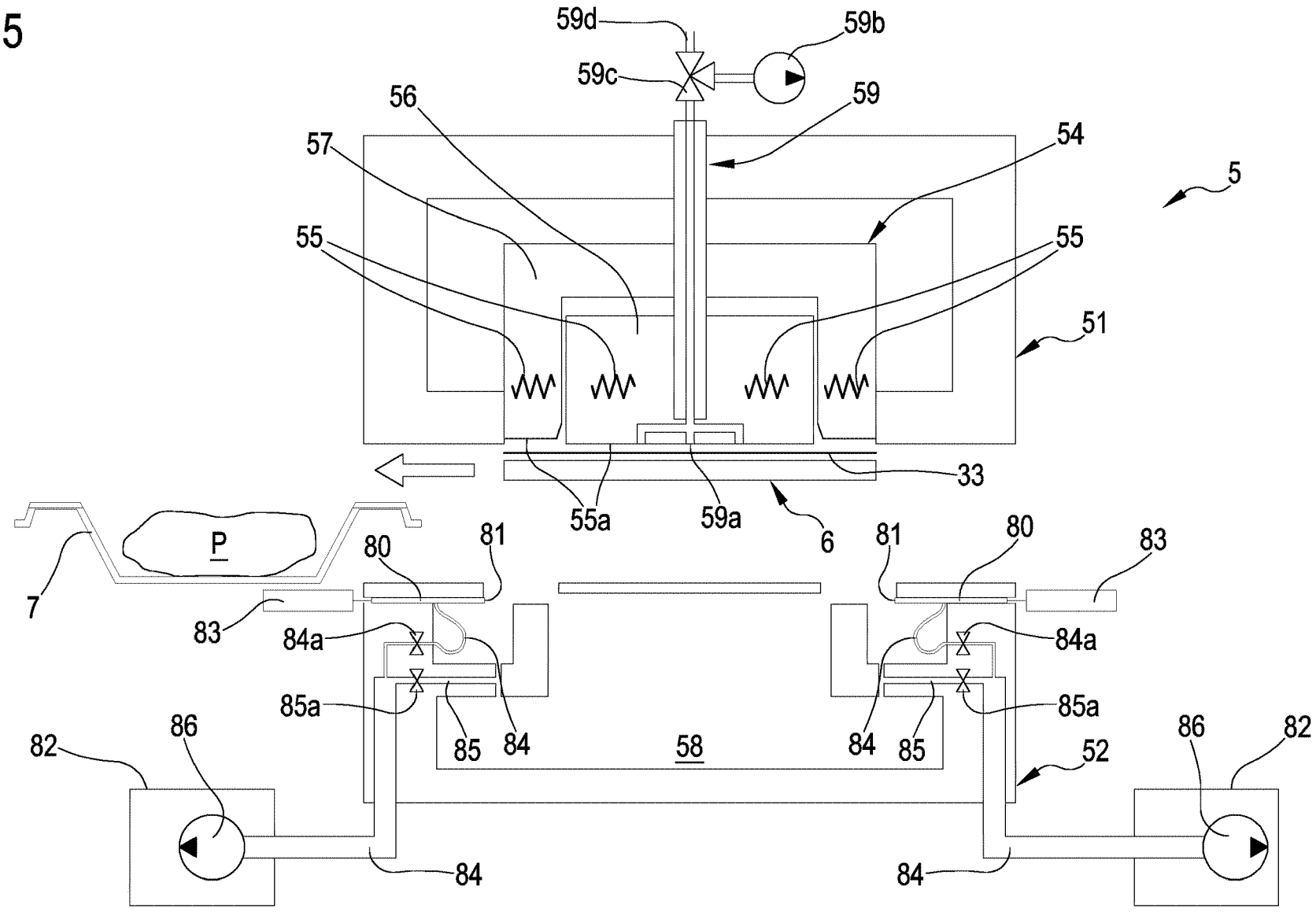
Figure 6:
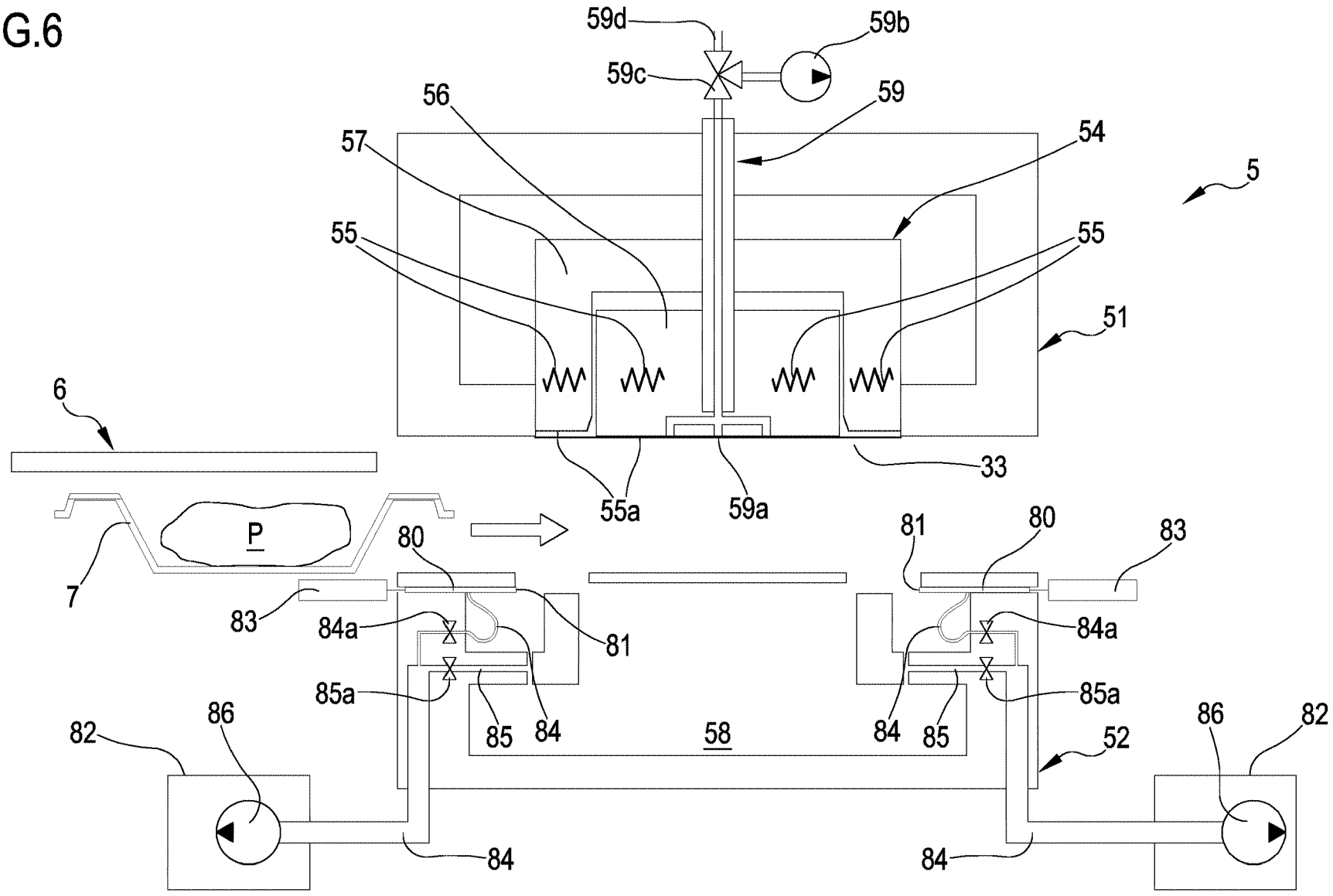
Figure 7:
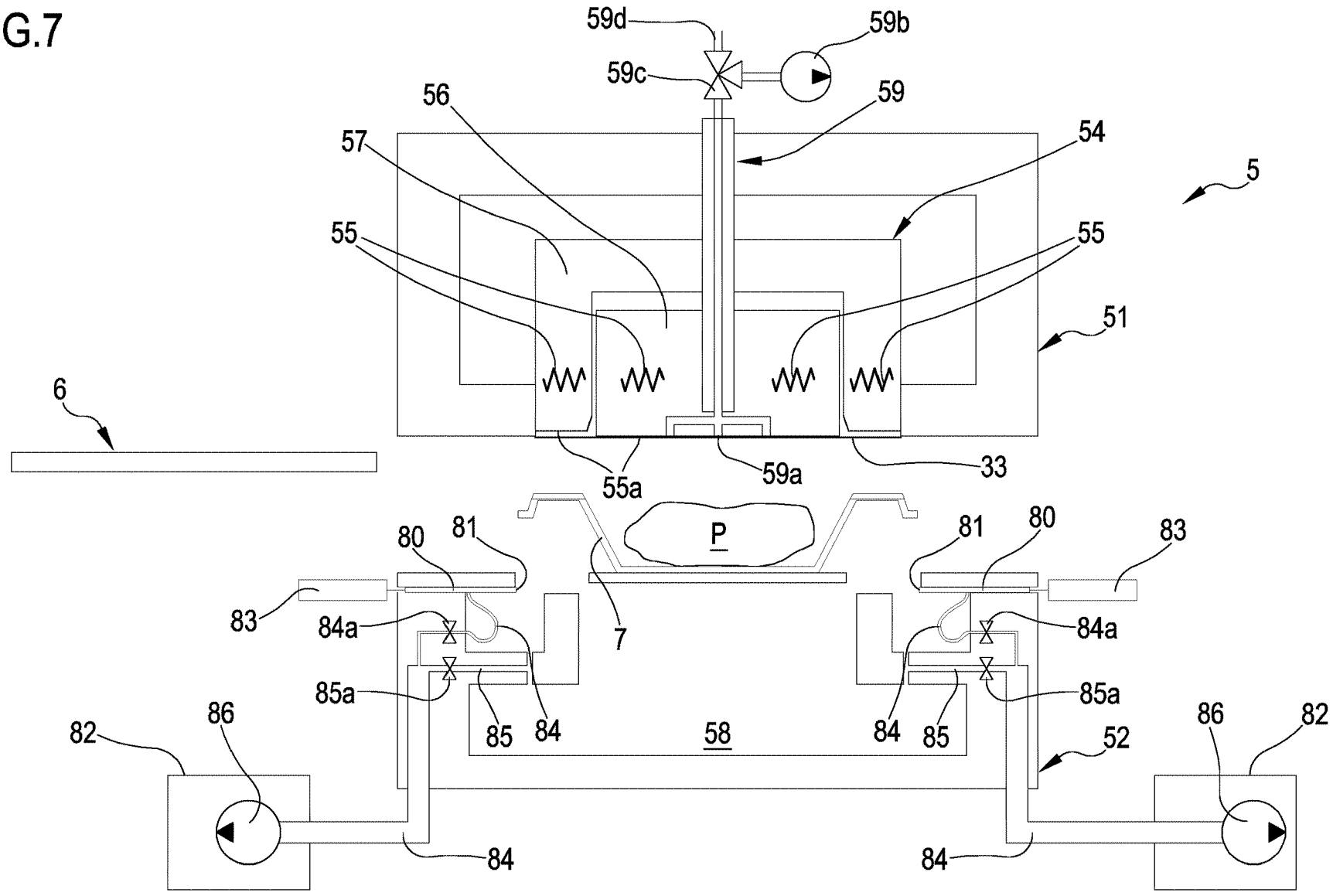

The optional film cutting assembly 4 (see FIG. 1) serves to at least transversally cut the continuous film 31 supplied by film supply assembly 3 into discrete film sheets 32 having the shape of the perimeter of the support or tray and having a radial size sufficient to cover the entire or substantially the entire support (the film sheet may in fact be slightly smaller than the plan view area of the tray or support as long as it is sufficiently big to cover the product and engage to the support or tray in a tight manner). The cutting assembly 3 is not essential with regard to the claimed invention: for instance (as shown in FIG. 2) a continuous film 31 may alternatively be directly supplied to the support or tray without being pre-cut into film sheets; in this case film cutting—if necessary—may take place after the film has been fixed to the support 7 and/or after air has been withdrawn from within the support 7 or even after the vacuum skin packages have been formed, e.g. downstream the packaging assembly. If the apparatus includes the cutting assembly 4, then the cutting assembly may either be located outside the packaging assembly (e.g., between the film supply assembly and the packaging assembly as shown in FIG. 2) or inside the packaging assembly 5 and associated to an upper tool 51 of the packaging assembly 5 (case schematically shown in FIG. 2) or to a lower tool 52 of the packaging assembly (case not shown). In case, the apparatus 1 is designed for cutting a continuous film 31 supplied by film supply assembly 3 into discrete film sheets 32 at a location (cutting assembly) spaced from and positioned outside a packaging assembly 5, then apparatus 1 also includes a transfer device 6 for transporting the cut film sheets into the packaging assembly 5, where the film sheets are bonded to the respective supports or trays. How the cut film sheets are transported into the packaging assembly and above the respective tray or support is not relevant: in other words, the transfer device 6 may be of any suitable kind. For instance, in accordance with a first possible alternative shown in FIG. 1 and in FIGS. 3-11, the transfer device 6 may include a transfer mechanism acting on the cut film sheet(s) and transporting the cut film sheets 32 from the cutting assembly 4 into the packaging assembly 5. In accordance with a possible alternative, the transfer device 6 may include a displacement mechanism configured to move the packaging assembly or a part thereof (e.g., an upper tool of the packaging assembly) to the position outside where the cutting assembly effects the cutting of the film sheets; in this way the upper tool is allowed to pick the cut film sheet(s) and return to the packaging assembly in alignment with a lower tool of the same packaging assembly. Note that other ways could be envisaged for transfer of a pre-cut film sheet or sheets inside the packaging assembly, without departing from the scope of the invention: in practice any solution adapted to pick the film sheet and transfer it into the packaging assembly may be suitable.

The packaging assembly 5, which is schematically shown in the appended figures, is carried by said frame 1*a* and is configured for receiving said one or more supports 7 with a product P arranged thereon and for holding a film portion 33 of said film (which may be a portion of a continuous film or a pre-cut film sheet) above a respective of said one or more supports 7, in order to then tightly fixing the film portions to the respective supports. As already mentioned, the packaging assembly includes a lower tool 52 and an upper tool 51. The lower tool 52 comprises a prefixed number of seats 53 for receiving said one or more supports, while the upper tool 51 is configured for holding the film portion 33 above the respective supports when these latter are properly positioned in the seats 53 provided in the lower tool. The upper tool and the lower tool are configured to be movable the one relative to the other between at least a first operating condition (see FIGS. 3-7 and 11), where the lower tool and the upper tool are spaced apart and allow positioning of the one or more supports at said seats, and a second operating condition (see FIGS. 8, 9, 9A, 9B, 9C and 10), where the lower tool and the upper tool are approached the one against the other such as to allow coupling of the film portion to the respective support.

For instance, in a non-limiting embodiment, the upper and lower tools when moved to the second operating condition define or contribute to define a packaging chamber 58 (see FIGS. 3-9 and 9B). In one aspect, the packaging chamber 58 may be hermetically closed with respect to the outside atmosphere, meaning that the packaging chamber 58 may be brought to a condition where it cannot freely communicate with the atmosphere outside the same chamber and gas may only be supplied or withdrawn from the chamber via appropriate supply or discharge channels under the control of the apparatus 1. On the other hand, in the examples of FIGS. 9A and 9C the upper and lower tools 51, 52 when in the second operating condition may simply bring the film portion in tight contact with the support, for instance with a peripheral band of the support top surface surrounding the product, without necessarily creating an hermetically chamber around the product loaded support and related film portion.

Making now reference to FIGS. 3-9, 10 and 11 which show a possible embodiment of a packaging assembly, the upper tool 51 is configured for holding said at least one film portion 33 and is provided with a heater 54 configured for heating the film portion 33 received in the packaging assembly 5. The heater 54 includes heating means 55 configured to heat at least the active surface 55*a* of the heater which is configured to come into contact with the film portion. The heating means 55 may include resistances or inductances (e.g. in the form of printed circuits) or other type of heating means located inside the heater or in proximity of the active surface (such has heating irradiators) and capable of at least directly or indirectly heating the active surface. The heating means are controlled by the control unit 100 which is configured for regulating the heating means such that the active surface of the heater is brought at least to an operating temperature comprised between 150° C. and 260° C., optionally between 180-240° C., more optionally between 200-220° C. In accordance with this embodiment, the heater 54 may be formed in two bodies (as shown in FIGS. 3-11) with a central body 56 and a surrounding heating bar 57: the central body 56 and the heating bar 57 may be relatively movable with respect to one another in order to have the possibility of approaching the peripheral heating bar to the underlying support before approaching the central body which may be used to hold the central area of the film portion. Moreover, the ability to relatively move the central body with respect to the heating bar 57 may allow skin packaging of products protruding above the support: the relative stroke between central body and surrounding heating bar may be more pronounced than what shown in the mentioned figures in case there is a to form packaging with significantly protruding products, i.e. protruding by several centimeters above the peripheral border or flange of the support 7.

One or more temperature sensors or one or more thermal switches may be positioned in correspondence or in proximity of heater in order to provide the control unit 100 with a feedback signal and allow control of the active surface temperature within the above ranges. In accordance with a preferred aspect, the control unit 100 controls the heating means 55 to keep the active surface at said operating temperature during the whole skin packaging cycle such that as soon as the film touches the active surface 55*a* it gets immediately and uniformly warmed.

As mentioned, the upper tool 51, and specifically the heater 54, includes holding means 59 for holding the film portion 33 inside the packaging chamber an above the tray or support 7 in said seat 53. In the example shown in the figures, the holding means comprises a plurality of suction apertures 59*a* leading to the active surface 55*a* of the heater, at least one vacuum source 59*b* (e.g. comprising a vacuum pump) controlled by the control unit 100 and connected to the suction apertures, and optionally at least one selector valve 59*c*, also controlled by the control unit 100, selectively connecting said suction apertures either to said vacuum source or to a vent line 59*d*. The control unit 100 may be configured to activate the holding means by switching the selector valve to a position where the valve connects the suction apertures to the vacuum source thereby causing suction of gas through the apertures. Alternatively, two valves may be used which may selectively be opened and closed to determine a fluid connection between said apertures either to the vacuum source or to the vent line. Note that in addition or in alternative to vacuum source the holding means may include one or more of the following:

- mechanical holders, such as pincers, clamps or the like,
- adhesive systems, for instance comprising adhesive portions associated to the active surface,
- heating systems, for instance comprising heatable portions—controlled by control unit 100—associated to the holding means for causing heating of the active surface and thus of the film portion in order to increase stickiness of the film to the active surface,
- electric systems, for instance the active surface may be charged with a polarity different from that typical of the plastic film. In this case the control unit may be connected to a voltage generator and may control the electric charging of surface.

Figure 9:
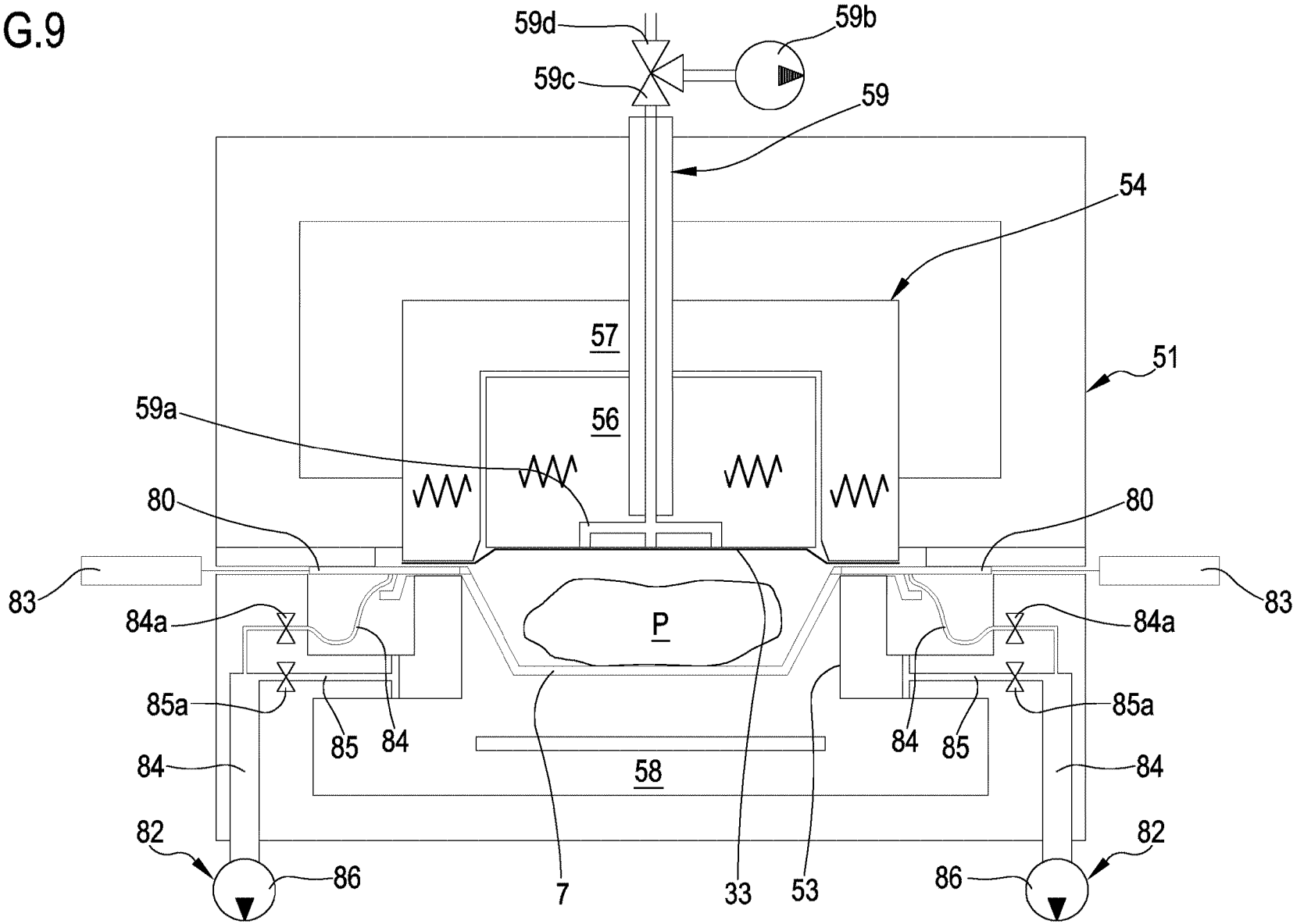
Figure 9A:
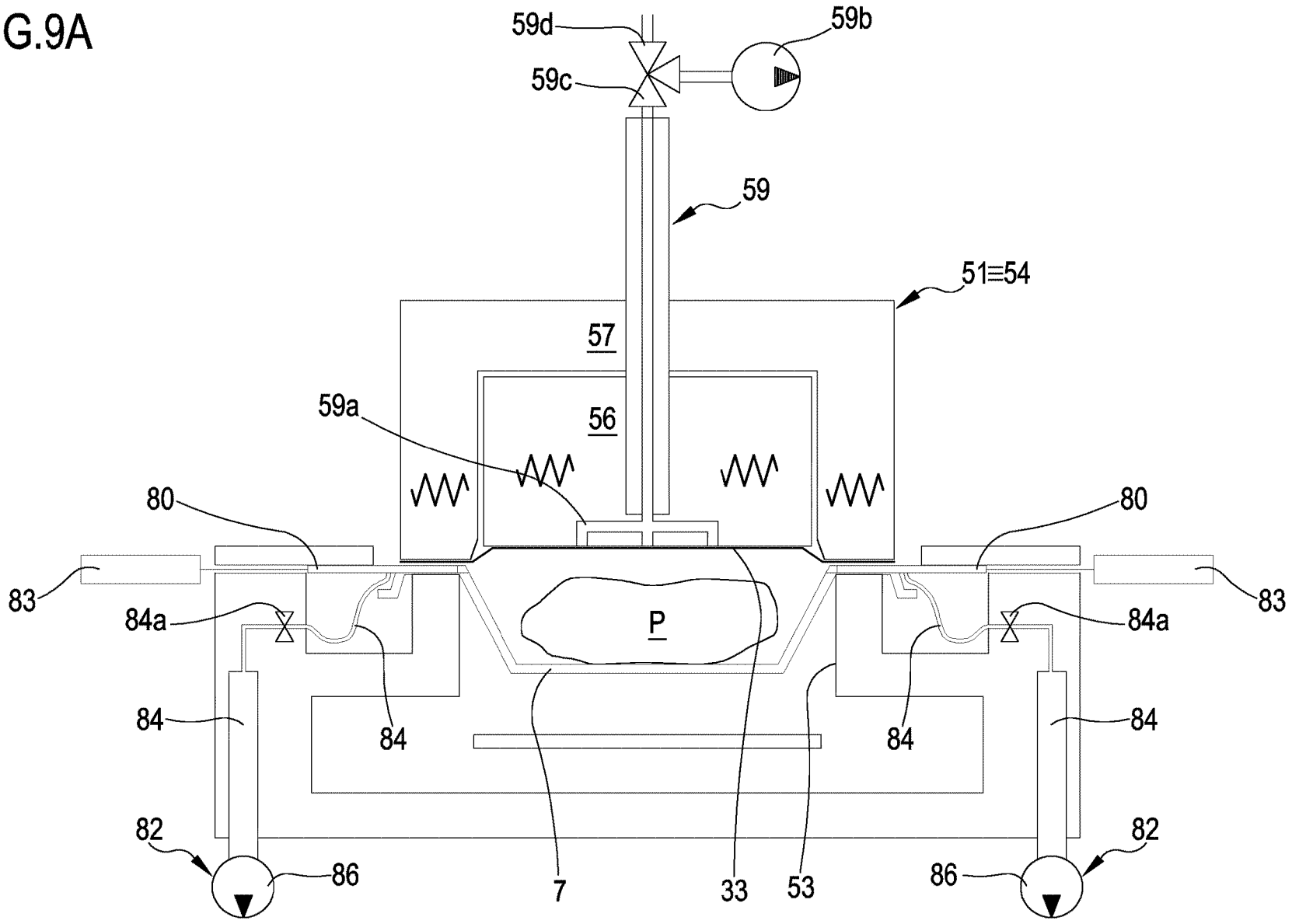
FIG. 9A shows a possible structure—alternative to that of FIGS. 3 to 8, 9, 10 and 11—of the packaging assembly of the apparatus of FIG. 1; according to the solution shown in FIG. 9A the packaging assembly does not form an hermetic chamber housing the film portion positioned above the product loaded tray to be sealed.

In the embodiment shown in FIG. 9A the packaging assembly may be basically identical to that of FIGS. 3-9, 10-11 but the upper tool and lower tool do not form a sealed packaging chamber 58 surrounding the product loaded tray and the film portion.

Figure 9B:
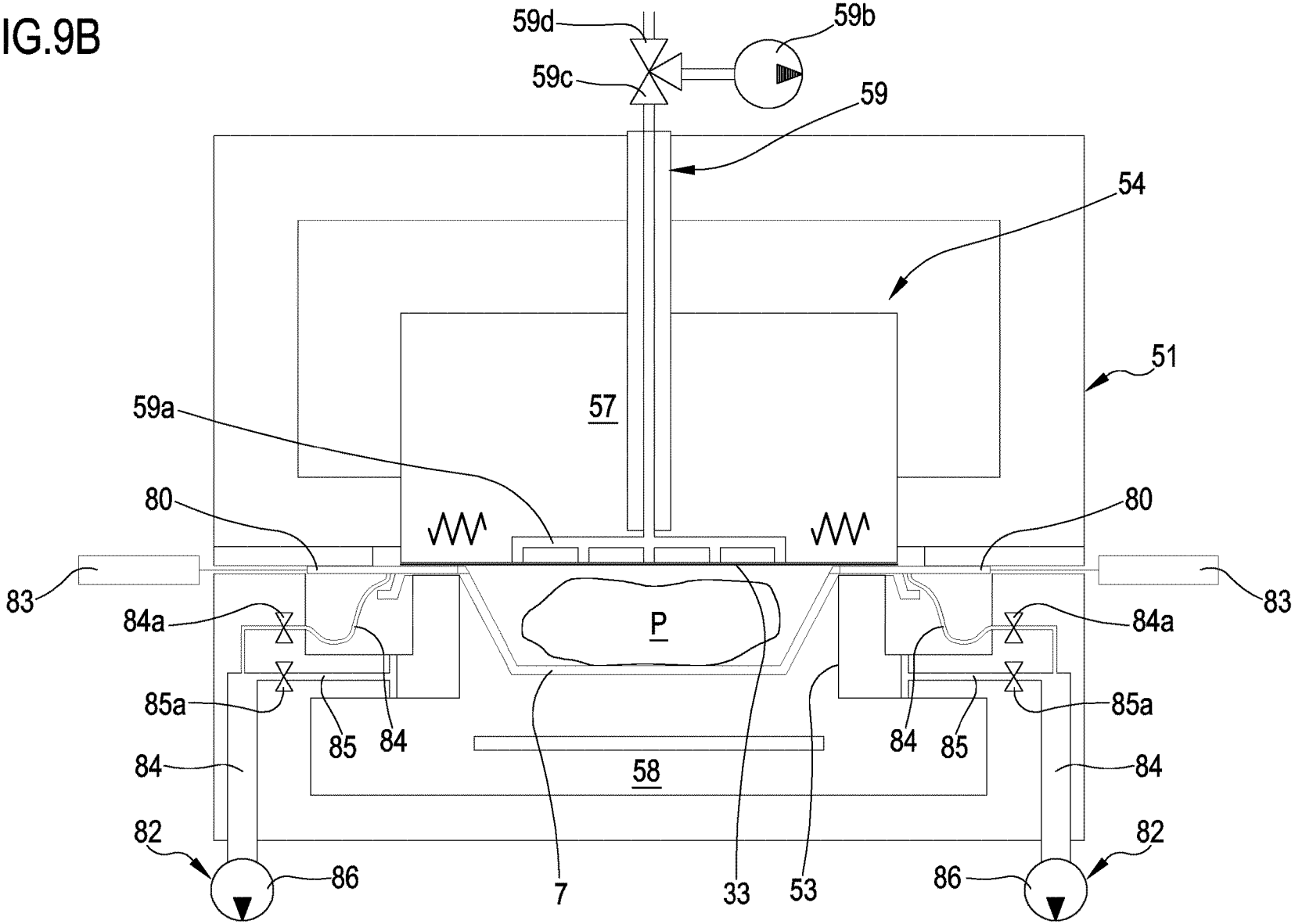
FIG. 9B shows a possible structure—similar to that of FIGS. 3 to 8, 9, 10 and 11—of the packaging assembly of the apparatus of FIG. 1; different from e.g.

In the embodiment shown in FIG. 9B the packaging assembly may be basically identical to that of FIGS. 3-9, 10-11 but have the heater 54 in the form of a single body 57 (such as a heating plate) having a continuous flat heating surface of a size sufficient to cover the film portion or the part of film portion vertically overlapping the support 7 positioned in the lower tool 52.

Figure 9C:
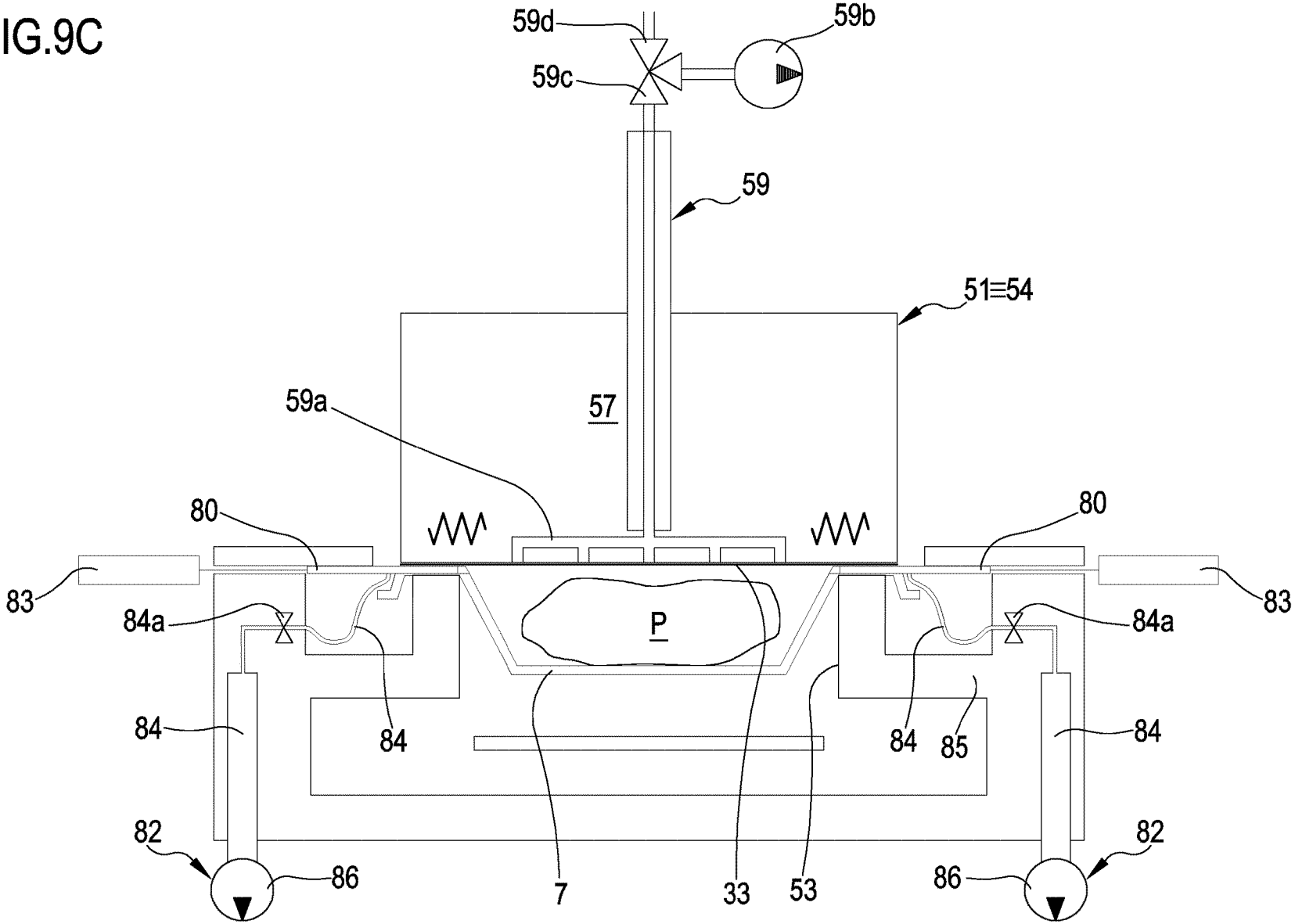
FIG. 9C shows a possible structure—alternative to that of FIGS. 3 to 8, 9, 10 and 11—of the packaging assembly of the apparatus of FIG. 1; according to the solution shown in FIG. 9C the packaging assembly does not form an hermetic chamber housing the film portion positioned above the product loaded tray to be sealed; moreover, the solution shown in FIG. 9C has the heater is in a single body.

In the embodiment shown in FIG. 9*c* the packaging assembly may be basically identical to that of FIG. 9A but have the heater 54 in the form of a single body 57 (such as a heating plate) having a continuous flat heating surface of a size sufficient to cover the film portion or the part of film portion vertically overlapping the support 7 positioned in the lower tool 52.

The packaging assembly 5 also includes at least one nozzle 80 provided with a suction aperture 81, and a vacuum arrangement 82 connected to the nozzle 80 and configured to cause suction of air through the nozzle in order to create a desired level of vacuum in the packaging chamber 58 and/or in the volume between the film portion and the support. In practice, the nozzle may be formed or positioned at the end of a tube 84 having an opposite terminal portion connected to the vacuum arrangement 82, which may include at least one vacuum pump 86 controlled by control unit 100. Optionally (see the embodiments of FIGS. 9 and 9B), the vacuum arrangement 82 may be connected to a further channel 85 in the lower tool 52. Both the tube 84 and the further channel 85, may be provided with a respective valve 84*a* and 85*a* for opening and closing passage of fluid under the control of control unit 100, may lead to the part of the packaging chamber 58 defined by the lower tool 52 and may also contribute to suck air in a controlled manner from the packaging chamber 58 (embodiments of FIGS. 9, 9B) when the chamber 58 is closed and a level of vacuum needs to be created in the same chamber 58.

Figure 8:
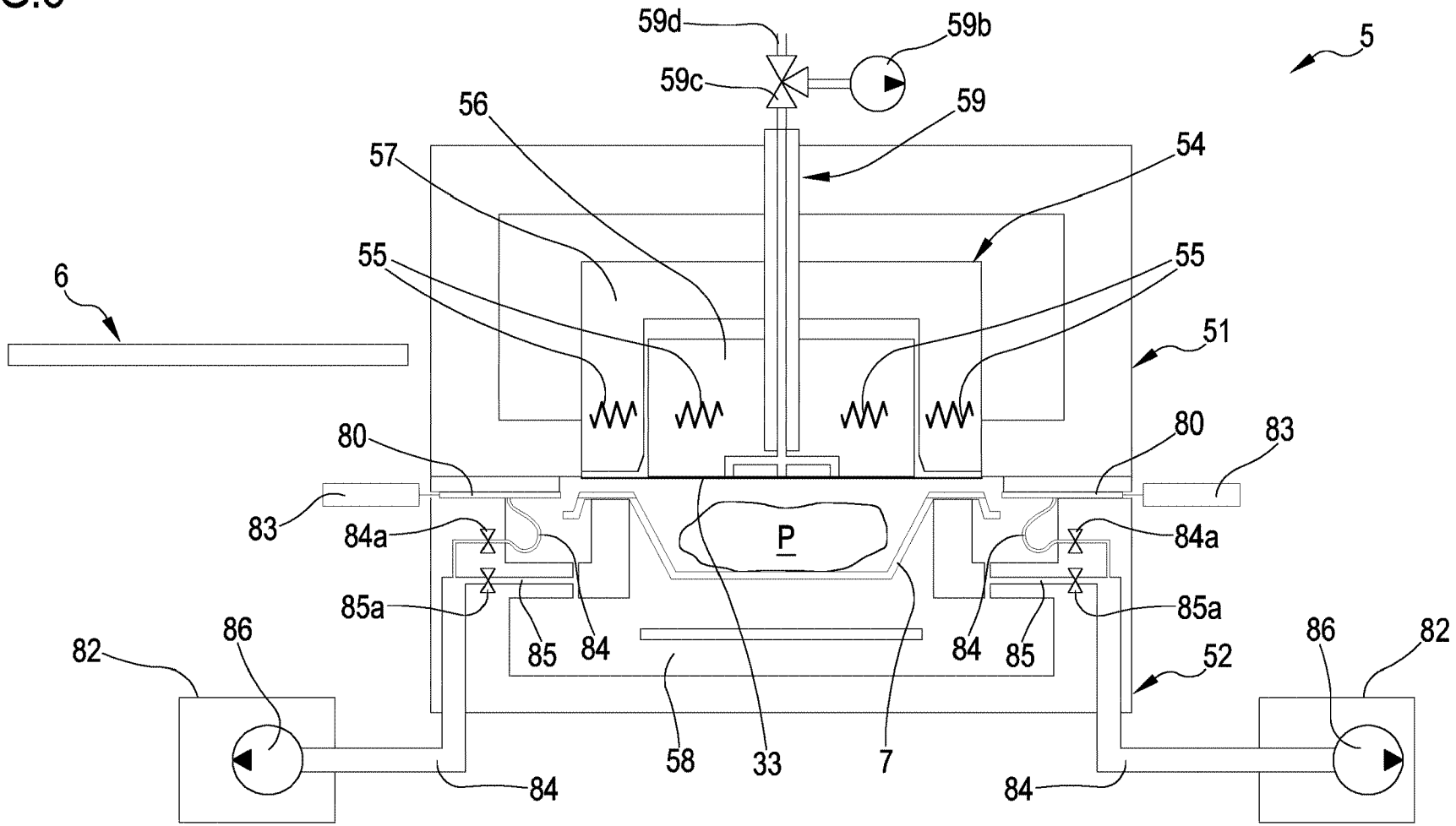
Figure 8A:
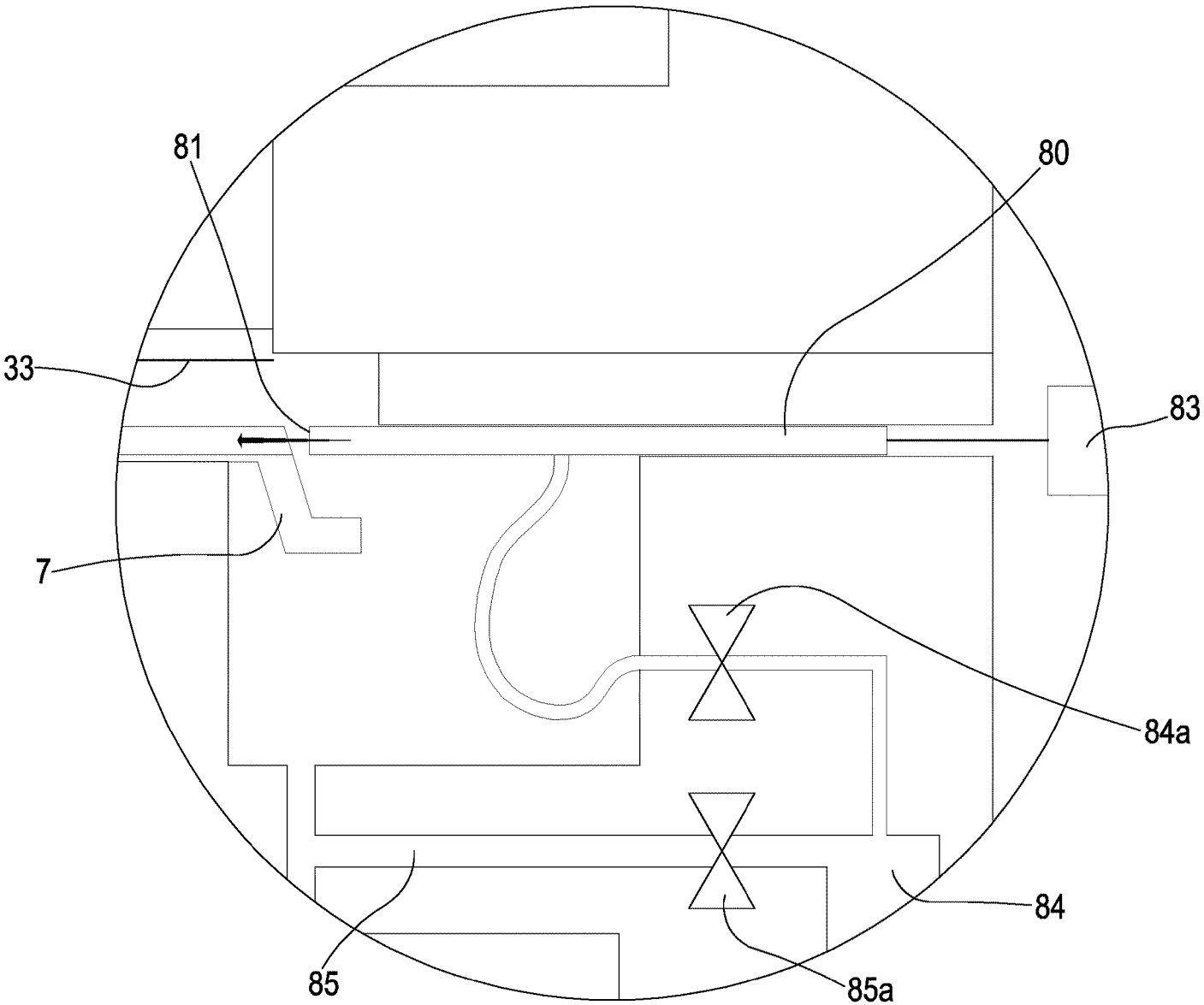
FIG. 8A is an enlarged view showing a particular of FIG. 8 relating to a nozzle used to withdraw air, with the nozzle in a rest condition.

In practice, the lower tool 52 and the upper tool 51 are configured to receive the film portion 33, hold it in place thanks to the holding means 55 and then position the film portion 33 in a holding position above the respective support 7 located in the seat 53: the nozzle is mounted in the packaging assembly for relative movement with respect to said upper and lower tools in order to position the nozzle as described below. The relative movement of the nozzle may be obtained by actually moving the nozzle (e.g., by means of an actuator 83 carried by the packaging assembly and active on the nozzle) or by moving the upper and lower tools relative to the nozzle (e.g., by means of actuators, not show in the drawings, acting on the upper and lower tools) or by moving the upper and/or lower tools and the nozzle. According to one aspect of the invention, the nozzle 80 is positionable between the bottom surface of the film portion 33 hold by upper tool and the upper surface of the support 7 positioned in a corresponding seat 53 of the lower tool and vertically aligned with said film portion (see FIGS. 8 and 8A). In greater detail, the control unit 100 of the apparatus 1 is also connected to the packaging assembly 5 and is configured for commanding the packaging assembly 5 or directly the nozzle 80 to position the nozzle in an interspace 90 between said upper surface of the support 7 and said bottom surface of the film portion 33. In practice, the nozzle 80 may movable by action of a nozzle actuator 83 acting e.g. between the lower tool and the nozzle as shown in the figures, and controlled by the control unit 100. As mentioned other alternatives are possible in order to position the nozzle 80 in the interspace 90: for instance the packaging assembly may be configured to move the support, the film portion and (after heat sealing is completed) the packaged product relative to the nozzle 80.

The control unit 100 is configured to control and timely synchronize:

- the relative position of the upper and lower tools, in particular bringing the upper and lower tools in their second operating condition (see FIGS. 8-10), once the tray or support 7 and the film portion 33 are in their appropriate positions inside the packaging assembly,
- the position of the nozzle 80, for instance by commanding nozzle actuator 83 to move back and forth the nozzle,
- the heater 54 to heat the film portion appropriately,
- the holding means 59 to keep the film portion attached to the heater,
- the vacuum arrangement 82 to withdraw air via the nozzle.

Depending upon the embodiments, when the lower tool and the upper tool are approached the one against the other in the second operating conditions they may define or contribute to define the packaging chamber 58 (FIGS. 9, 9B) or they may bring the heating surface of the heater 54 in air tight contact with a top surface of a peripheral band of the tray or support 7.

In greater detail, in the embodiments of FIGS. 9, 9B the control unit 100 causes the heater 54 to heat the at least one film portion 33 held above the support and causes the vacuum arrangement 82 to evacuate air from below the film portion by sucking gas through the suction aperture of the nozzle 80 while the nozzle positioned in said interspace 90 and while the packaging chamber is closed. Once an appropriate level of vacuum has been reached below the film portion 33 (or in the packaging chamber 58), the control unit may command the holding means 59 to release the film portion 33 such that the film portion contacts the product and heat bonds to a free surface of the support forming a heat bonding 91 surrounding the product. By virtue of the vertical alignment between the film portion 33 and the respective support 7 in the packaging assembly 5, and by virtue of the specific position of the nozzle 80, said heat bonding 91 air tightly closes the product between the support and the film portion thereby forming a vacuum skin packaged product: in practice the heat bonding 91 entirely surrounds the perimeter 93 of the contact area 92 between product P and support 7, while the nozzle remains radially outside the heat bonding 91 (see FIG. 10 where the contact area 92 is defined on the base of the support or tray 7 and where the heat bonding 91 is an annular band formed e.g., at the side wall and surrounding entirely the perimeter 93 of the contact area product/support). It is noted that since in the embodiments of FIGS. 9 and 9B an hermetically closed vacuum chamber 58 may be formed before the film portion is brought into contact with the underlying support (see e.g., FIG. 8), then the control unit may start withdrawing air from the vacuum chamber before the heater 54 has been brought to the position of FIGS. 9 and 9B, i.e. before the film portion contacts the top surface of the support 7.

In the embodiments of FIGS. 9A and 9C the control unit 100 causes the heater 54 to heat the at least one film portion 33 held above the support and causes the heater to move in the position shown in FIGS. 9A and 9C where the film portion contacts the top surface of the support substantially along a peripheral band. More in detail, the control unit also causes the vacuum arrangement 82 to evacuate air from below the film portion by sucking gas exclusively through the suction aperture(s) of the nozzle(s) 80 while each nozzle positioned in said interspace 90 and while the film portion is in sealing contact with the top surface of the support 7 and with portion of the side surface of the nozzle. Once an appropriate level of vacuum has been reached below the film portion 33, the control unit may command the holding means 59 to release the film portion 33 such that the film portion contacts the product and heat bonds to a free surface of the support forming a heat bonding 91 surrounding the product. By virtue of the vertical alignment between the film portion 33 and the respective support 7 in the packaging assembly 5, and by virtue of the specific position of the nozzle 80, said heat bonding 91 air tightly closes the product between the support and the film portion thereby forming a vacuum skin packaged product: in practice the heat bonding 91 entirely surrounds the perimeter 93 of the contact area 92 between product P and support 7, while the nozzle remains radially outside the heat bonding 91 (the contact area 92 is defined on the base of the support or tray 7 and the heat bonding 91 is an annular band formed e.g., at the side wall and surrounding entirely the perimeter 93 of the contact area product/support).

According to one aspect, the nozzle or at least an external coating applied to the nozzle is made in non-stick material; suitable non-stick materials for example may be: polytetrafluoroethylene (PTFE), anodized aluminum, ceramics, silicone, enameled cast iron, and seasoned cast iron. The above avoids that the nozzle 80—while still inserted in the interspace between the film portion and the support—heat bonds to the support or to the film portion.

After the heat bonding has been completed such that the product is tightly closed against the support, the control unit 100 commands the packaging assembly to remove the nozzle 80 from said interspace 90 by relatively displacing the nozzle with respect to the support. In greater detail, the nozzle 80 (e.g., under the action of said nozzle actuator 83) may be brought between a working condition—where the nozzle is inserted in said interspace 90—and a rest condition—where the nozzle is totally extracted from the interspace 90 and positioned at a prefixed distance from the peripheral border of the support present in the lower tool such as not to interfere with further movement imposed to the formed packaging which needs to be extracted from the packaging assembly.

In summary, once the packaging chamber 58 has been closed and the nozzle 80 has been inserted in the working condition (FIGS. 8,9, 9B) or once the film portion 33 has been brought into tight contact with at least a peripheral band or flange of the support 7 and with the side surface of the nozzle inserted in the working condition (FIGS. 9A, 9C), the vacuum arrangement 82 may be operated by the control unit to suck air at least via the nozzle 80 with the control unit 100 controlling the vacuum pump 86 and/or the valves 84*a* and/or 85*a* of the vacuum arrangement 82 to withdraw gas from below the film portion 33 and optionally from said packaging chamber 58 (for those cases where the packaging assembly is hermetically closed forming a packaging chamber). Once gas withdrawal and heat bonding have been performed, the control unit 100 may move the nozzle 80 back to the rest condition and command opening of the packaging chamber or at least movement of the upper and lower tools to the first operating condition to thereby allow extraction of the formed vacuum packaging from the packaging assembly: extraction may either be manual or be made with any conventional extraction device.

In accordance with a possible aspect, which applies to the embodiments where the upper and lower tool may have the ability to form a vacuum chamber 58, a state of vacuum inside the chamber 58 and below the film portion 33 may be created also while keeping the film portion 33 separate from the tray or support 7 while vacuum arrangement 82 is already active. In other words, the control unit 100 may command the packaging assembly 5 (i.e., the holding means 59) to hold the film portion above the respective support (see FIG. 8), to then position the nozzle in the working position and to subsequently cause the vacuum arrangement to evacuate air from below the film portion by sucking gas through the suction aperture of the nozzle. Air evacuation may thus be started while the film portion 33 is still hold by the holding means 59. In other words, depending upon the circumstances the vacuum arrangement 82 may be activated while the film portion is held above the support or contemporaneously to the step of release of the film portion. At a prefixed moment in the cycle or at the reaching of a certain level of vacuum, the control unit may command the holding means 59 to release the film portion 33 such that at least a part of the film portion separates from the heater and contacts the product while heat bonding to a free surface of the support surrounding the product.

The control unit 100 is also configured to then command the removal of the nozzle from said interspace by relatively displacing the nozzle with respect to lower tool and thus with respect to the support present in the lower tool. In a further specific aspect, the control unit 100 may be configured to create a vacuum in the packaging chamber (by controlling the vacuum pump 86 to withdraw gas from said packaging chamber) until a sufficiently low pressure has been reached (e.g. below 100 mbar or below 50 mbar or below 10 mbar), while still holding the film portion attached to the heater. This pressure level is sufficiently low but not too low so that detachment of the film from the heater is avoided (at least during this first phase) as the control unit also creates a pressure level in correspondence of the suction holes or apertures 59*a* of the holding mean 59, by acting on vacuum source 59*b*, below the pressure level reached in the packaging chamber. Once a desired state of vacuum is reached inside the chamber 58, the control unit 100 commands the holding means to release the film portion: this may be achieved by commanding selector valve (or valves) to switch the vent line in communication with the suction apertures. The vacuum causes the film to drape down to the tray or support and to form a skin around the product also attaching to the tray or support surface not occupied by the product. At this point the control unit may control again the packaging assembly and lift the upper tool, also causing extraction of the nozzle from the interspace thereby allowing extraction of the packaged product. The cycle described above may then be repeated.

It is noted that in a preferred embodiment the control unit 100 is configured to command the heater 54 to heat the film portion 33 while the same film portion is in its holding position above the support. Furthermore, although the nozzle 80 may be partially extracted from the interspace 90 before the heat bonding 91 is completed, the control unit 100 is preferably configured to cause the nozzle 80 to be completely removed from said interspace only after the heat bonding has air-tightly closed the product between the support and the film portion. In particular, the control unit 100 may be configured to maintain the nozzle 80 in the interspace 90 between the film portion 33 and the support 7 at least until after the upper tool 51 has been moved away from the lower tool 52 and the heater 54 has been separated from the film portion which is being bonded to the support. In an alternative, or additionally, the control unit 100 may be configured to maintain the nozzle 80 in the interspace 90 between the film portion and the support at least until the heater surface facing the film portion is brought to a temperature below the temperature causing heat bonding of the film portion to the support. In this manner, the nozzle is always interposed between the film portion and the support while the film is at a temperature to have heat bonding properties to the support and is only removed once the film has reached a condition where it cannot bond to the support so that at least one film flap 33*a* (see FIGS. 13 and 14) is formed which is located above said interspace and which does not heat bond to the underlying support. Furthermore, the control unit 100 may be configured to command the vacuum arrangement 82 to interrupt suction of gas through the nozzle suction aperture 81 before displacing the nozzle with respect to the support and place the nozzle in the rest condition at a prefixed distance from the peripheral border of the support. In other words, although the control unit may command the relative displacement of the nozzle to begin before interrupting suction of gas through said nozzle (such that the nozzle continues to suck air at least during an initial phase of its extraction from the interspace), suction is interrupted before the nozzle is completely extracted from the interspace between the film portion and the support.

Figure 10:
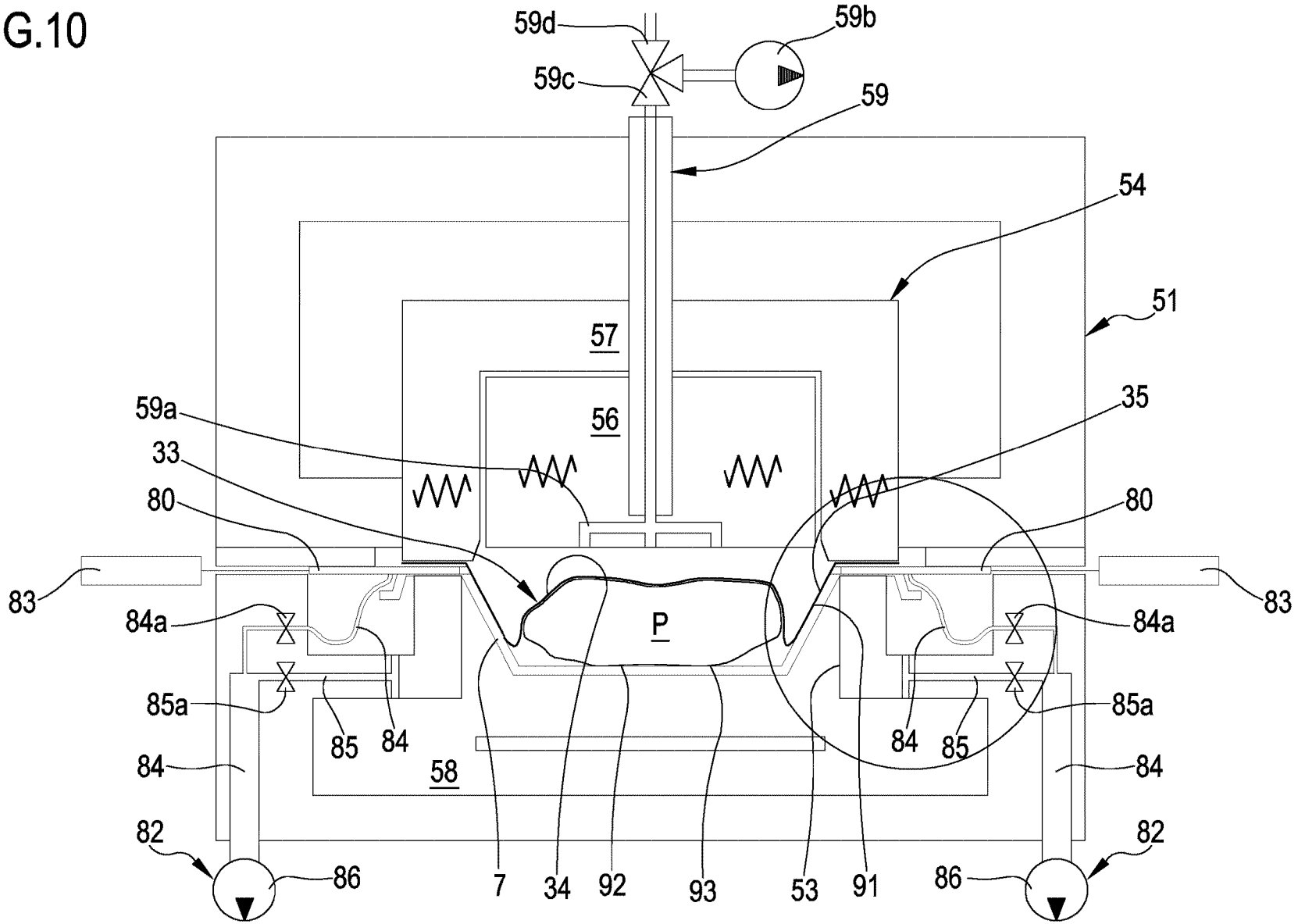
Figure 10A:
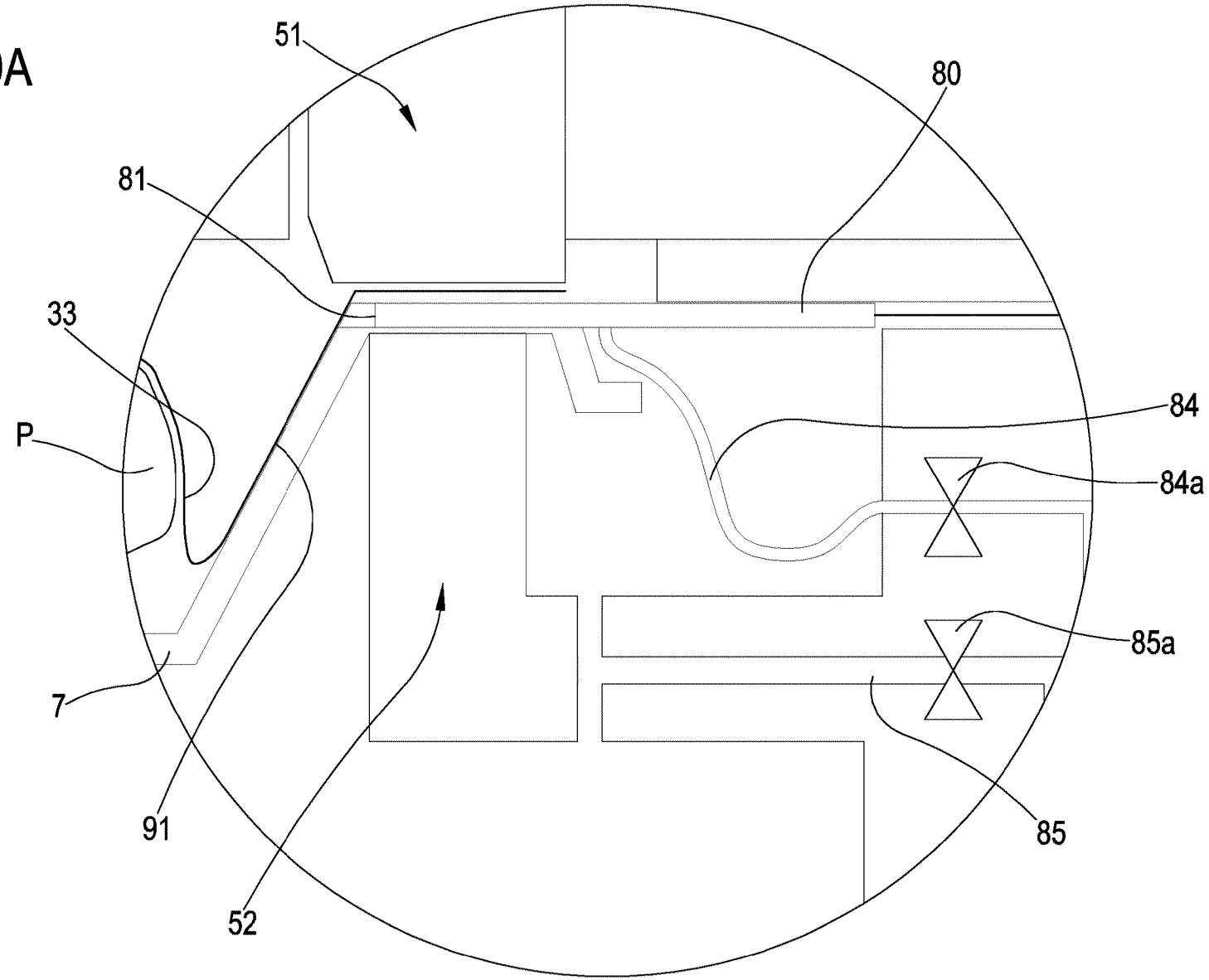
FIG. 10A is an enlarged view showing a particular of FIG. 10 concerning the nozzle of FIG. 8A moved to a working condition.
Figure 11:
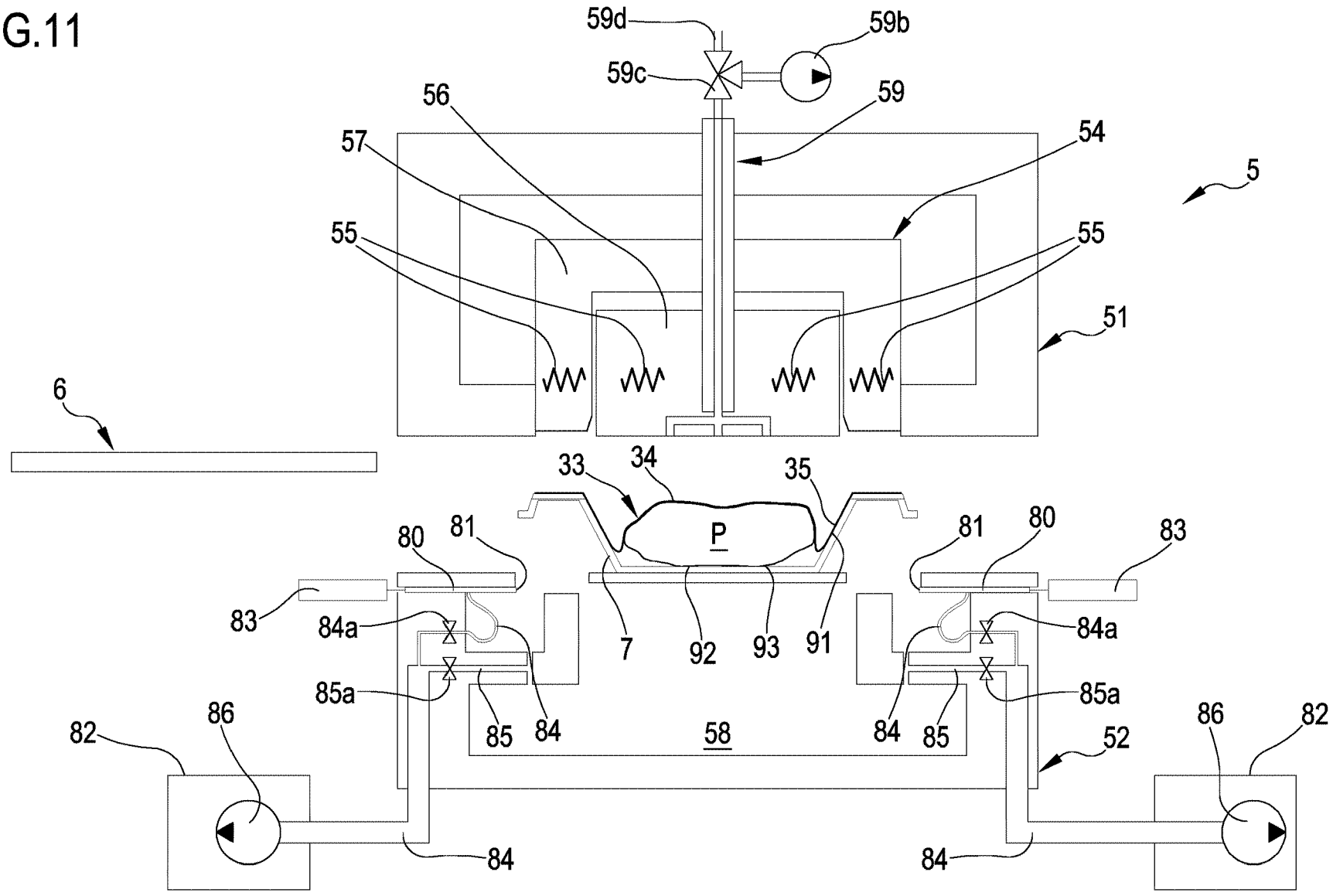

In accordance with one aspect of the invention, the lower tool 52 is configured for receiving a support in the shape of a tray comprising a bottom wall 7*a* and a side wall 7*b* upwardly extending from said bottom wall. The tray may also include a top flange 7*c* extending radially outside from the side wall upper portion. In this case, the control unit 100 commands the packaging assembly to position the nozzle 80 in the working condition in the interspace 90, which is defined between a lower surface of the film portion hold by the upper tool and either the flange upper surface (if the tray has a flange) or the upper portion of the side wall of a tray positioned in the lower tool. In particular, the control unit 100 may be configured to command the packaging assembly to position the nozzle—when in the working condition—such that the nozzle radially extends beyond an outer border of the tray flange (in order to be connected to the vacuum arrangement—see FIGS. 10A, 13 and 14) but does not radially extend significantly beyond an inner border of the tray flange of a tray positioned in said lower tool. In practice the suction aperture may be positioned, in the working condition of the nozzle, flush with the side wall inner surface of the tray 7 (see FIG. 10A). Also in the case of a tray as support, the control unit 100 commands the holding means 59 associated to the upper tool to hold the film portion 33 in contact with a heating surface of a heater 54 carried by the upper tool while said film portion is being positioned above the tray 7 positioned in the lower tool: in one aspect, the control unit may command the vacuum source to keep the film portion in contact with said suction apertures until the film portion peripheral border has contacted the flange of the tray.

As trays or supports 7 may present a polygonal shape (in a plan view) the lower tool may further be configured to receive a support having a polygonal peripheral border: in case of flat supports a plurality of corner regions are present in the perimeter of the flat support, while in case of trays corner regions are defined either on the top border of the side wall and/or on the flange. In case the support 7 has corner regions, the control unit may configured to command the packaging assembly to position the nozzle 80 in the working condition in an interspace 90 defined at a corner region of the peripheral border of the tray or support positioned in the lower tool.

As already mentioned, in accordance with an aspect of the invention, the lower tool 52 may be configured for receiving a support in the shape of a tray 7 comprising a bottom wall 7*a*, a side wall 7*b* upwardly extending from said bottom wall and an optional a top flange 7*c* extending radially outside from the side wall upper portion. In a variant of this aspect of the invention, the flange 7*c* or the top portion of the side wall 7*b* of the tray 7 may include an indent 7*d* (see FIG. 12) configured for receiving the nozzle 80. In particular, the nozzle cross section presents a profile counter-shaped to the profile of the indent 7*d* and is sized such that when the nozzle is in the working condition the top surface of the nozzle is flush with the top surface of the flange (if present) or with the top border of the tray side wall (see FIG. 10A).

In an alternative (not shown in the drawings), in order to position the nozzle in the working condition, the upper tool comprises a recess configured for receiving said nozzle: in particular, the nozzle cross section presents a profile counter-shaped to the profile of the upper tool recess; in this manner in case of flat supports or of entirely flat flanges the nozzle does not interfere with the support and smoothly positions in the working condition, with the bottom surface of the nozzle being flush to the bottom surface of the heating surface of the heater.

In yet another alternative the upper tool 51 comprises a recess configured for receiving part of said nozzle, while the flange 7*c* or the top portion of the side wall 7*b* of the tray 7 may include an indent 7*d* configured for receiving a bottom part of the same nozzle 80. In other words the nozzle while in working position may be hosted in a seat formed by said recess and/or said indent.

The indent 7*d* or the recess in the upper tool and thus the nozzle cross section may present a polygonal, e.g. quadrilateral profile. Furthermore, the indent 7*d* may be located at a corner region of the tray.

The control unit is configured to command the packaging assembly (e.g., the upper and lower tools and the nozzle actuator) to position the nozzle in said interspace either in the indent present in the tray or in the recess present in the upper tool.

Packaging Process

The invention also concerns a packaging process, in particular a vacuum skin packaging process. Exemplary embodiments of the packaging process of the invention are now described which may be for example executed using the apparatus described above or claimed in any one of the appended claims.

In accordance with aspects of the invention, a vacuum skin packaging process comprises the following steps. A support 7 for example of the type described above is provided: the support may be made in a separate apparatus or it may be thermoformed online at a thermoforming station of the apparatus 1. A product P is loaded on the supports at a loading station which may be part of the apparatus or located upstream the apparatus: in any case the loading of the product leaves the support with a free surface, which surrounds the product and which is not contacted by the product; the free surface serves as an area where the film may be bonded to the support. While the supports 7 are provided and moved towards the packaging assembly 5, a film 31 is supplied by the film supply station 3 to the packaging assembly 5. As explained above, the film may be supplied to the packaging assembly as a continuous film or it may be cut into discrete film sheets before reaching the packaging assembly: if the film portion is a discrete piece of film it is preferable that the film portion substantially has the radial size of the support; if a tray with flange is used the film portion in the form of a film sheet shall present the radial size of the tray flange or at least shall be sized enough to have a peripheral border overlapping with the flange all around the tray perimeter. In any case, the process comprises the step of holding at least one film portion 33 above the product loaded support or supports 7 present in the packaging assembly. When the product loaded support 7 and the respective film sheet or film portion 33 have reached the packaging assembly and have been placed in proper vertical alignment, the nozzle 80 is positioned in the interspace 90 between an upper surface of the support and a bottom surface of the film portion, such that the suction aperture 81 of the nozzle may evacuate air from the volume under the film portion and above the support. While the film portion 33 is hold by the upper tool 51 of the packaging assembly in its holding position above the support, the heater 54 provides for heating of the at least one film portion. The process also comprises evacuating air from below the film portion by sucking gas through a suction aperture of the nozzle; evacuation of air may start while the film portion 33 is still hold by the heater 54 (this is possible in those cases where the upper and lower tools form a packaging chamber 58 as described above). Then once a desired level of vacuum has been reached in the packaging chamber or at least in the volume defined between the support and the respective film portion, or after a prefixed time period has lapsed since the start of the evacuation, the film portion is released by the upper tool and in particular by the active surface of the heater. As explained in the apparatus section, when air evacuation takes place the upper and lower tools 51 and 52 may have formed a hermetically closed chamber and/or the film portion has been brought into contact with a peripheral border or band of the underlying support forming a sealing contact with the support and with a portion of the side surface of the nozzle inserted between support and upper tool; furthermore air evacuation may use further channels 85 connected to the vacuum arrangement 82 (see e.g., FIGS. 9 and 9B). Release may take place once the film portion 33 has been brought into contact with the respective support (at least in some points of this latter). Release of the film portion allows the film portion 33 to drape down and to contact the product P and heat bond to the free surface of the support 7. In particular, the process requires the heat bonding 91 to completely encircle the area (or areas) of contact 92 between product P and support 7 so as to air tightly close the product between the support and the film portion and form a vacuum skin packaged product. More precisely, when the film portion 33 is finally bonded to the respective support 7 the film portion comprises an inner film portion 34, which is in contact with the product P, and an outer film portion 35, entirely surrounding the perimeter of the inner film portion 34 and heat bonded to the top surface or free surface of the support not covered by the product P in such a manner to form the heat bonding annular band 91 also entirely surrounding the perimeter of the inner film portion. Once the product has been air tightly closed, the nozzle 80 may be removed from said interspace by relatively displacing the nozzle with respect to the support and the vacuum skin package thus obtained may be moved out of the packaging assembly. In particular, although the nozzle 80 may be partially removed from the interspace 90 also when heat bonding is not complete, the nozzle is completely removed from the interspace only after the heat bonding has airtightly closed the product between the support 7 and the film portion 33.

As explained also in the section relating to the detailed description of the apparatus 1, the nozzle 80 is inserted between an upper surface of a peripheral border of the support 7 and a lower surface of a peripheral border of the film portion 33, such that the suction aperture of the nozzle is directed towards a volume comprised between the support and the film portion, but without intruding too much into said volume in order to allow formation of a perfect skin on the product and on the free surface of the support.

In accordance with certain aspects of the invention, it is further noted that the step of evacuating air may take place also while the film portion 33 is in its holding position above the respective product loaded support (see examples of FIGS. 3-9 and 9B where an hermetically closed chamber 58 may be formed), and continues after releasing the film portion and until formation of said heat bonding 91 which tightly closes the product between the support and the film portion, thereby maximizing the skin effect. Instead, in the embodiments of FIGS. 9A and 9C, evacuation takes place only through the nozzle or nozzles 80 and only once the film portion 33 has tightly contacted the top surface of the underlying support 7 and a portion of the side surface of the nozzle or nozzles 80 inserted in their working condition.

In accordance with a further aspect of the invention a flap 33*a* is formed during the packaging process for the easy peel of the film portion 33 and thus for facilitating opening of the vacuum skin package formed with the apparatus and process described above. In greater detail, the nozzle—which is made in a material not sticking or bonding to the film—is kept in the interspace 90 between the film portion and the support while said heat bonding step is taking place and is substantially finished, such that at least one film flap 33*a* is formed, which is located above said interspace 90 and which does not heat bond to the underlying support 7, thereby forming a grip element for easy opening of the skin package. In further detail, in order to form said flap the nozzle is removed, in particular completely removed, from said interspace after the heater 54 is separated from the film portion, or after the heater surface facing the film portion is brought to a temperature below the temperature causing heat bonding of the film portion to the support.

As described above, air is sucked through the nozzle in order to create the necessary level of vacuum for obtaining a skin package. Once the film portion 33 is heat bonded to the free surface of the support surrounding the product, the process provides for interrupting suction of gas through the nozzle suction aperture 81, and for relatively displacing the nozzle 80 with respect to the support to place the nozzle in a rest condition at a prefixed distance from the peripheral border of the support, while maintaining the suction of air interrupted. In accordance with a possible alternative, extracting of the nozzle 80 from the interspace 90 begins before interrupting suction of gas through said nozzle such that the nozzle continues to suck air at least during an initial phase of its extraction from the interspace.

As mentioned in the above description the process and apparatus of the invention may be used to form a skin package using a tray 7 comprising a bottom wall 7*a* and a side wall 7*b* upwardly extending from said bottom wall: in this case is film portion is heat bonded to a free surface of the side wall 7*b* of the tray (and in certain cases also to a free surface of the base) and forms a heat bonding in the form of a closed annular band 91 extending all around the product which normally rests on and only contacts the base of the tray.

In case the tray comprises a top flange 7*c* extending radially outside from the side wall upper portion, the interspace 90 is defined between an upper surface of the tray flange 7*c* and a lower surface of the film portion 33: in this situation, a periphery of the film portion is bonded to upper surface of the flange along the entire perimeter of the flange with the exception of a zone of the flange located at said interspace; this also allows to form at least one film flap 33*a* not heat bonded to the underlying flange. In case of a tray with a flange 7*c*, the nozzle is inserted between an upper surface of the tray flange and a lower surface of a peripheral border of the film portion, with the nozzle does and particularly the nozzle distal tip which does extend beyond the inner border of the tray flange. In this way, when the nozzle is in the working condition the suction aperture 81 is substantially flush with the inner surface of the side wall 7*b* of the tray, thereby not interfering with the drape down movement and the bonding of the film portion 33 to the support 7.

In a further specific variant, the support has a polygonal peripheral border: in this case the process may provide to position the nozzle 80 in an interspace 90 defined at a corner region of the support peripheral border between the upper surface of the support and the bottom surface of the film portion. For example, when the support is a tray with a side wall and a radially protruding top flange, the peripheral border of the flange may be polygonal and the nozzle may be positioned in the interspace defined at a corner region of the flange peripheral border between the upper surface of the flange and the bottom surface of the film portion.

Finally, in accordance with a specific aspect the support may be a tray with a flange (or with top portion of the side wall) having an indent 7*d* configured for receiving said nozzle: in accordance with a possible embodiment, the indent 7*d* is formed by a reduction in the height of the side wall, has a constant depth and has an extension along the perimeter of the flange or of the side wall which is at least twice the depth of the indent. In practice the side wall of the tray presents a same height all along its perimeter with the exception of the areas where the indent 7*d* is formed, said indent having an elongated conformation in a plane parallel to the base of the tray. As the nozzle cross section presents a profile counter-shaped to the profile of the indent, the nozzle cross section takes an elongated conformation and is preferably polygonal, for example rectangular. Moreover, the nozzle suction aperture 81 optionally comprises a plurality of suction orifices regularly distributed at the distal end of the nozzle: for instance the suction orifices may be positioned according to a plurality of parallel lines, which are oriented along the elongation of the cross section. In particular the indent is located at a corner region of the side wall of the tray. It is noted that the flap 33*a* is formed in correspondence and above the indent 7*d*.

In accordance with an alternative which may be adopted for flat supports or for trays having no indents the upper tool comprises a recess configured for receiving said nozzle: in detail the nozzle cross section presents a profile counter-shaped to the profile of the upper tool recess, and this latter may be configured to have a constant depth and an extension along an horizontal plane which is at least twice the depth of the recess.

When the nozzle 80 is inserted in the interspace and in particular when the nozzle is sucking air the nozzle is located either in the indent 7*d* present in the tray or in the recess present in the upper tool, such that in the first case the nozzle top surface remains flush with the top flange or top border of the tray 7 and in the second case the bottom surface of the nozzle remains flush with the active surface of the heater 54. As already mentioned, however, it may be provided that both the tray has an indent and the upper tool has a corresponding recess configured to cooperate in use with the intent of the support to receive the nozzle in the working condition.

Figure 14:
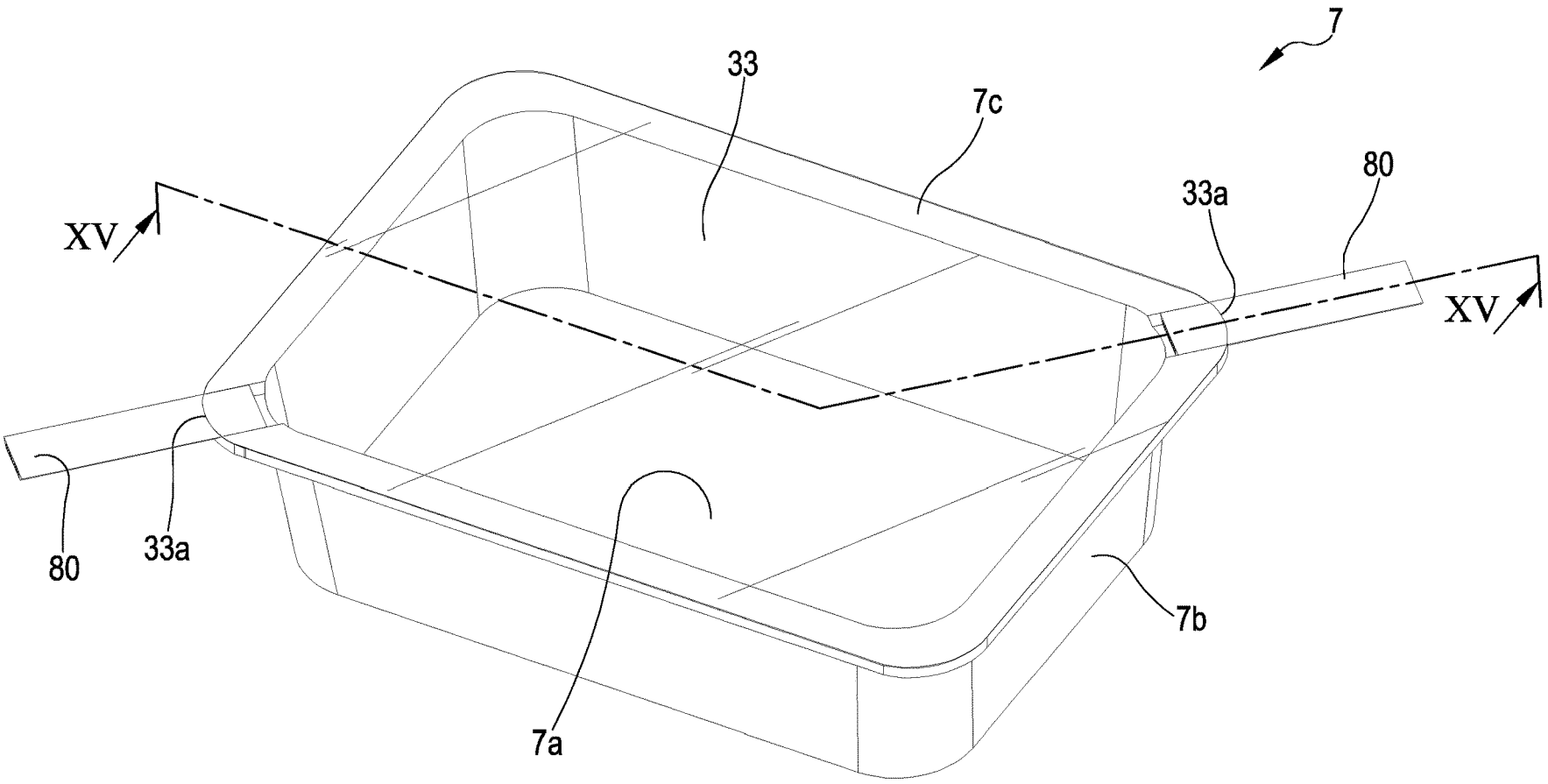
FIG. 14 is a view of the tray analogous to that of FIG. 13 with a film sheet applied to the tray top flange and two nozzles inserted in the respective interspace between the film sheet and the tray flange at two opposite corner recesses; this figure shows a situation before application of vacuum (for sake of clarity the product P is not represented)
Figure 14A:
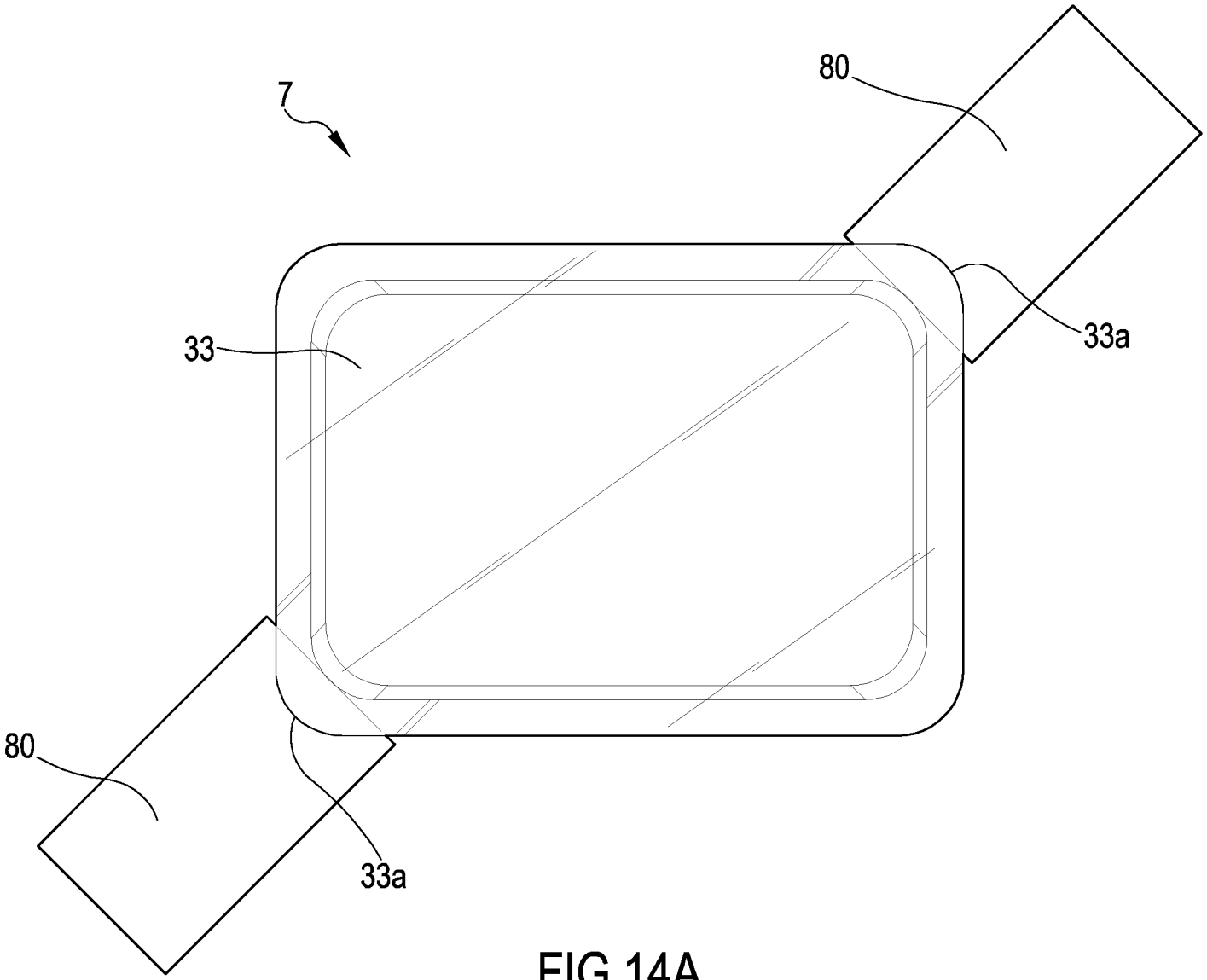
FIG. 14B is a schematic top view of tray according to a variant with a film sheet applied to the tray top flange and two nozzles inserted in the respective interspace between the film sheet and the tray flange at two opposite corner recesses; this figure shows a situation before application of vacuum (for sake of clarity the product P is not represented)
Figure 15:
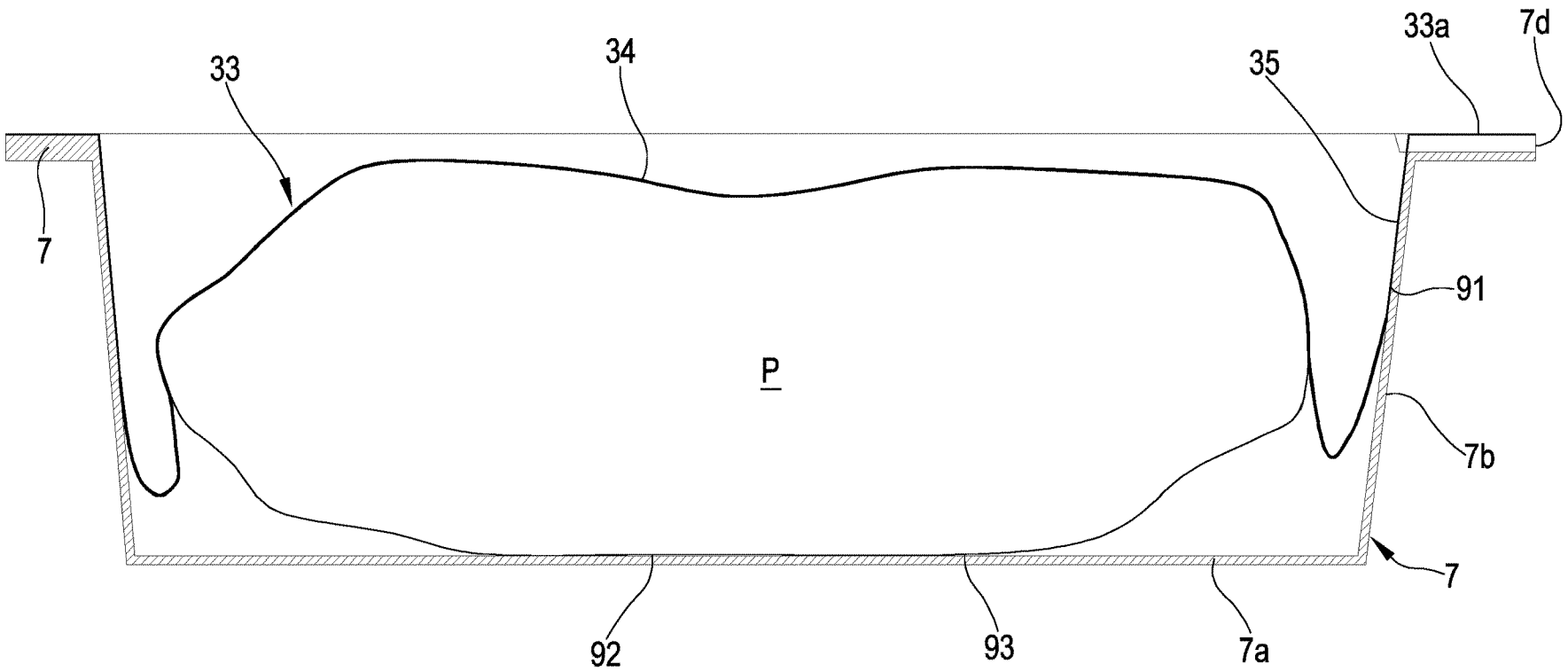
FIG. 15 is a cross section view taken along section surface XV-XV of the tray of FIG. 14, with a product P inside the tray and after vacuum has been applied to form a vacuum skin packaging.

FIGS. 14 and 14A show two alternative embodiments of the nozzle 80 and of the respective indent 7*d* in the tray flange: in FIG. 14 the nozzle and the indent are relatively narrow compared to the width of the recess and of the nozzle of FIG. 14. As a consequence the solution of FIG. 14 is more suitable for the case where the nozzle is displaced e.g., by actuator 83, between the working and rest positions, because the flap formed in the case of FIG. 14 has scarce mobility without compromising the seal of the film over the support. By contrast, adopting the solution shown in FIG. 14A where the nozzle (and the indent) is configured and positioned to extend all across the corner region of the tray (namely at least touching or crossing the two converging external straight edges of the flange or of the perimeter of the flat support) then the flap 33*a* can be easily lifted without compromising the seal and thus the nozzle may be extracted either by moving the nozzle with the actuator 83 or by moving the packaged product relative to the nozzle (e.g. lowering lower tool or moving or moving the packaged product away from the packaging assembly with appropriate extractors).

Control Unit of Apparatus 1

The apparatus according to the invention has of at least one control unit 100. The control unit (schematically represented in FIGS. 1 and 2) is at least connected to the transport assembly, the packaging assembly (and in particular with the vacuum arrangement and the holding means), the cutting assembly, the actuators necessary to impart movement to the nozzle and to the upper and/or lower tools, to the cutting assembly if present. The control unit governs the steps of the process described above and in particular is configured for commanding the transport assembly to displace said support along the predefined path, the film supply assembly to supply the film according to respective step-by-step motions; the control unit also commands the packaging assembly and thus all the actuators described above in order to tightly fix the film portion to said support when this latter has reached the packaging assembly; furthermore, the control unit commands the nozzle between the rest and the working conditions. For instance, with the aid of position sensors the control unit may determine when the support and respective film portion are positioned in the packaging assembly and command displacement of the nozzle from the rest position to the working position and then activate the suction of air as described above.

The control unit may comprise a digital processor (CPU) with memory (or memories), an analogical type circuit, or a combination of one or more digital processing units with one or more analogical processing circuits. In the present description and in the claims it is indicated that the control unit is "configured" or "programmed" to execute certain steps: this may be achieved in practice by any means which allow configuring or programming the control unit. For instance, in case of a control unit comprising one or more CPUs, one or more programs are stored in an appropriate memory: the program or programs containing instructions which, when executed by the control unit, cause the control unit to execute the steps described and/or claimed in connection with the control unit. Alternatively, if the control unit is of an analogical type, then the circuitry of the control unit is designed to include circuitry configured, in use, to process electric signals such as to execute the control unit steps herein disclosed.

The Vacuum Skin Package

The apparatuses and processes described above may be suitable for making a vacuum skin package hosting at least one product, as described above and as claimed in any one of the attached claims.

In particular, according to a specific aspect of the invention and referring to FIGS. 12 to 15, the support 7 may be a tray presenting a bottom wall 7*a*, which may be circular, oval, or polygonal, optionally rectangular, in shape, and a side wall 7*b* upwardly extending from the bottom wall and having a top flange 7*c*, which is outwardly directed and serves as an abutment for the film portion. The tray may be made with the materials indicated above. The flange 7*c* may have an indent 7*d* configured for receiving the nozzle: according to an optional aspect, the indent is formed by a reduction in the height of the side wall, has a constant depth and has an extension along the perimeter of the flange or of the side wall which is at least twice the depth of the indent. In practice the side wall of the tray presents a same height all along its perimeter with the exception of the areas where an indent is formed having an elongated conformation in a plane parallel to the base of the tray. The tray 7 hosts a product P which rests on the base wall 7*a*. The product P may also contact the side wall 7*b*, but leaves at least a portion of the side wall internal surface free: in particular the free surface entirely surrounds the perimeter 93 of the contact area or areas 92 between product and the inner surface of the tray. The skin package using tray 7 includes film portion 33, which is heat bonded to the free surface of the side wall 7*b* of the tray (and in certain cases also to a free surface of the base) and forms a heat bonding in the form of a closed annular band 91 extending all around the product which normally rests on and only contacts the base of the tray. A periphery of the film portion 33 may be bonded to upper surface of the flange 7*c* along the entire perimeter of the flange with the exception of a zone of the flange to form at least one film flap 33*a* not heat bonded to the underlying flange. In case of a tray with a flange 7*c*, the flap is formed in correspondence and above of the indent 7*b*. In particular the flap extends along the perimeter of the flange at least, optionally exactly, as the indent 7*b*. As already mentioned, the indent and thus the flap may present the configuration shown in FIG. 14, or the configuration shown in FIG. 14A. In FIG. 14, both the flap 33*a* and the indent 7*b* are delimited on both sides by a distinct sealing line (connecting the film to the support) extending transverse to the external peripheral border of the flange or of the support. The two sealing lines are in practice directed radially with respect to the cavity or area where the product is hosted. In FIG. 14A the film is only attached to the support at a single sealing line which is basically crossing the corner region of the support tangentially with respect to the cavity or area where the product is hosted.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. A vacuum skin packaging process comprising:

providing a support comprising an indent formed therein;

providing a film;

loading the support with a product, such that the product leaves a free surface of the support not contacted by the product;

holding a film portion above the product loaded support in a holding position;

inserting a nozzle into the indent and in an interspace between an upper surface of the support and a bottom surface of the film portion;

heating the film portion;

evacuating air from below the film portion by sucking gas through a suction aperture of the nozzle;

releasing the held film portion; and allowing the released film portion to contact the product and heat bond to the free surface of the support, the heat bonding forming an air-tight closure of the product between the support and the film portion thereby forming a vacuum skin packaged product;

wherein the nozzle is kept in the indent and the interspace while heat bonding is taking place, such that at least one film flap is formed where the nozzle is kept during heat bonding, wherein the at least one film flap is located above the indent and is not heat bonded to the support, thereby forming a grip element for opening of the vacuum skin packaged product.

2. The process of claim 1, wherein removing the nozzle from the interspace is performed after the releasing the film portion and allowing the film portion to contact the product and heat bond to the free surface of the support.

3. The process of claim 1, wherein air evacuation takes place only through the nozzle and only when the film portion has been brought into sealing contact with a peripheral border or band of the support forming a sealing contact with the support and with a portion of a side surface of the nozzle inserted in the interspace.

4. The process of claim 3, wherein:

the heating the film portion takes place by action of a heater, carried by or forming an upper tool, while the film portion is in its holding position above the respective product loaded support, the releasing the film portion from the upper tool takes place after approaching the upper tool and a lower tool and bringing the film portion in contact with the support, after the step of releasing, at least part of the heated film portion separates and moves away from the heater draping down onto the product.

5. The process of claim 4, wherein:

the upper tool comprises a recess configured for receiving the nozzle, the nozzle cross section presenting a profile counter-shaped to a profile of the upper tool recess, and when the nozzle is inserted in the interspace, the nozzle is located, in the recess present in the upper tool.

6. The process of claim 1, wherein the nozzle is removed from the interspace only after heat bonding has formed the air-tight closure of the product between the support and the film portion.

7. The process of claim 1, wherein the support is a tray comprising a bottom wall and a side wall upwardly extending from the bottom wall and wherein the film portion is heat bonded to a free surface of the side wall of the tray and forms a heat bonding.

8. The process according to claim 7, wherein the tray comprises a top flange extending radially outside from an upper portion of the side wall, and wherein the interspace is defined between an upper surface of the top flange and the bottom surface of the film portion.

9. The process of claim 8, wherein the film portion is bonded to the upper surface of the flange along an entire perimeter of the flange except for a zone of the flange located at the interspace, to form the at least one film flap not heat bonded to the flange.

10. The process of claim 8, wherein the film portion is held in contact with a heater of an upper tool also while the film portion is being positioned above the product loaded tray and while the film portion is being placed into contact with the flange of the tray.

11. The process of claim 7, wherein the support has a polygonal peripheral border and wherein the nozzle is positioned in the interspace defined at a corner region of the support peripheral border between the upper surface of the support and the bottom surface of the film portion.

12. The process of claim 11, wherein a radially protruding top flange of the peripheral border of the flange is polygonal and the nozzle is positioned in the interspace defined at the corner region of the flange peripheral border between the upper surface of the flange and the bottom surface of the film portion, further wherein the film portion is a discrete piece of film having, when held in its holding position above the product loaded support, a size covering substantially all of the upper surface of the support.

13. The process of claim 7, wherein:

a flange or a top portion of the side wall of the tray comprises the indent configured to receive the nozzle, the nozzle cross section presenting a profile counter-shaped to a profile of the indent; and when the nozzle is inserted in the interspace, the nozzle is located in the indent present in the tray.

* * * * *